US010570649B2

(12) United States Patent
Yokota

(10) Patent No.: US 10,570,649 B2
(45) Date of Patent: Feb. 25, 2020

(54) DOOR LOCK APPARATUS

(71) Applicant: GECOM CORPORATION, Greensburg, IN (US)

(72) Inventor: Yoshiaki Yokota, Farmington Hills, MI (US)

(73) Assignee: GECOM CORPORATION, Greensburg, IN (US)

( * ) Notice: Subject to any disclaimer, the term of this patent is extended or adjusted under 35 U.S.C. 154(b) by 376 days.

(21) Appl. No.: 15/679,565

(22) Filed: Aug. 17, 2017

(65) Prior Publication Data

US 2019/0055755 A1 Feb. 21, 2019

(51) Int. Cl.

| | |
|---|---|
| ***E05B 81/06*** | (2014.01) |
| ***E05B 81/34*** | (2014.01) |
| ***E05B 81/14*** | (2014.01) |
| ***E05B 85/02*** | (2014.01) |
| ***E05B 81/20*** | (2014.01) |
| *E05B 47/00* | (2006.01) |
| *E05B 81/22* | (2014.01) |

(52) U.S. Cl.

CPC ..... *E05B 81/06* (2013.01); *E05B 81/14* (2013.01); *E05B 81/20* (2013.01); *E05B 81/34* (2013.01); *E05B 85/02* (2013.01); *E05B 81/22* (2013.01); *E05B 2047/0013* (2013.01)

(58) Field of Classification Search

CPC ..... E05B 81/06; E05B 81/22; E05B 81/20; E05B 81/12; E05B 81/14; E05B 81/24; E05B 81/25; E05B 79/04; E05B 79/20; E05B 2047/0013; E05B 2047/0087; E05B 2047/0014; H02K 7/00; H02K 7/116; H02K 16/00

USPC ..... 292/201

See application file for complete search history.

(56) References Cited

U.S. PATENT DOCUMENTS 10,400,488 B2 * 9/2019 Dufay
2005/0241237 A1 * 11/2005 Hirai ..... E05B 81/22 49/360

(Continued)

FOREIGN PATENT DOCUMENTS

DE 10242830 12/2003
DE 102007032779 1/2009

(Continued)

OTHER PUBLICATIONS

European Search Report re Application No. 18189213.4; 6 pages.

*Primary Examiner* — Nathan Cumar
(74) *Attorney, Agent, or Firm* — Foley & Lardner LLP

(57) ABSTRACT

A door lock apparatus has a lock mechanism for holding a vehicle door in a closed state, an assisting mechanism for assisting in closing and/or opening the vehicle door, and a driving portion for operating the assisting mechanism, and the driving portion has a plurality of motors in which output shafts are disposed parallel to each other and pinion gears are provided individually on the output shafts, a rotational shaft which is disposed parallel to the respective output shafts of the plurality of motors, an internal ring gear which is fixed to a first end portion of the rotational shaft and which meshes with the respective pinion gears of the plurality of motors, and a worm which is fixed to a second end portion of the rotational shaft and which is configured to transmit power to the assisting mechanism.

8 Claims, 15 Drawing Sheets

(56) References Cited

U.S. PATENT DOCUMENTS

| | | | | |
|---|---|---|---|---|
| 2009/0071207 | A1* | 3/2009 | Meyer | B64C 25/26 70/262 |
| 2013/0147210 | A1* | 6/2013 | Dufay | E05C 3/12 292/98 |
| 2016/0186468 | A1* | 6/2016 | Ilea | E05B 79/04 292/201 |

FOREIGN PATENT DOCUMENTS

| | | | |
|---|---|---|---|
| JP | H09-046969 | A | 2/1997 |
| JP | 3550141 | B2 | 8/2004 |
| WO | WO-2015-006859 | A1 | 1/2015 |

* cited by examiner

DOOR LOCK APPARATUS

TECHNICAL FIELD

The present invention relates to a door lock apparatus.

BACKGROUND ART

A driving apparatus described in Japanese Patent No. 3550141 is intended to operate an assisting mechanism for assisting in closing or opening of a vehicle door. The driving apparatus includes a plurality of drive sources and operates the assisting mechanism through rotation of a worm wheel which meshes with worms which are provided individually on the plurality of drive sources.

A dual motor apparatus described in WO2015/006859 is intended to be used for a powered latch system for opening or closing a closure panel such as a vehicle door, for example. This dual motor apparatus includes a plurality of motors and operates a latch element through rotation of a worm wheel which meshes with worms which are provided individually on the plurality of motors so as to assist in opening or closing the closure panel.

An electric motor unit described in JP-A-9-46969 is an electric motor unit in which rotational forces of a plurality of motors are combined together so as to be outputted as drive and includes a drive shaft on which a main gearwheel is mounted and a plurality of motors which are disposed into a circle around a circumference of the drive shaft. Pinion gears having the same diameter and configured to mesh individually with the main gearwheel are mounted individually on the plurality of motors.

SUMMARY

Relatively great torque is necessary to assist in closing or opening a vehicle door. In the driving apparatus described in Japanese Patent No. 3550141 and the dual motor apparatus described in WO2015/006859, the plurality of drive sources are used, and the individual drive sources used are relatively small in size so that the resulting driving and dual motor apparatuses are reduced in size.

However, a relatively high rear ratio is necessary to obtain torque which is great enough to assist in closing or opening a vehicle door from such small drive sources, and a corresponding outside diameter is needed for the worm wheel. The plurality of drive sources and the worm wheel are disposed on the same plane, and the respective worms of the plurality of drives sources mesh with an outer circumference of the worm wheel. This makes it difficult to reduce the size of the driving apparatus or the dual motor apparatus in a radial direction of the worm wheel.

In the electric motor unit described in JP-A-9-46969, too, the pinion gears of the plurality of motors mesh with an outer circumference of the main gearwheel mounted on the drive shaft, and hence, this also makes it difficult to reduce the size of the electric motor unit in a radial direction of the main gearwheel.

This disclosure has been made in view of the situations described above, and an object of the invention is to provide a door lock apparatus which can be made small in size.

A door lock apparatus according to this disclosure is a door lock apparatus configured to be provided on a vehicle door, comprising: a lock mechanism configured to hold the vehicle door in a closed state; an assisting mechanism configured to assist in closing and/or opening the vehicle door; and a driving portion configured to operate the assisting mechanism, wherein the driving portion comprises: a plurality of drive sources, in which output shafts are disposed parallel to each other and pinion gears are provided individually on the output shafts; a rotational shaft that is disposed parallel to the respective output shafts of the plurality of drive sources; an internal ring gear, which is fixed to a first end portion of the rotational shaft, and which meshes with the respective pinion gears of the plurality of drive sources; and an output gear, which is fixed to a second end portion of the rotational shaft, and which is configured to transmit power to the assisting mechanism.

According to the disclosure, it is possible to provide the door lock apparatus which can be made small in size.

DESCRIPTION OF ILLUSTRATIVE EMBODIMENTS

Figure 1:
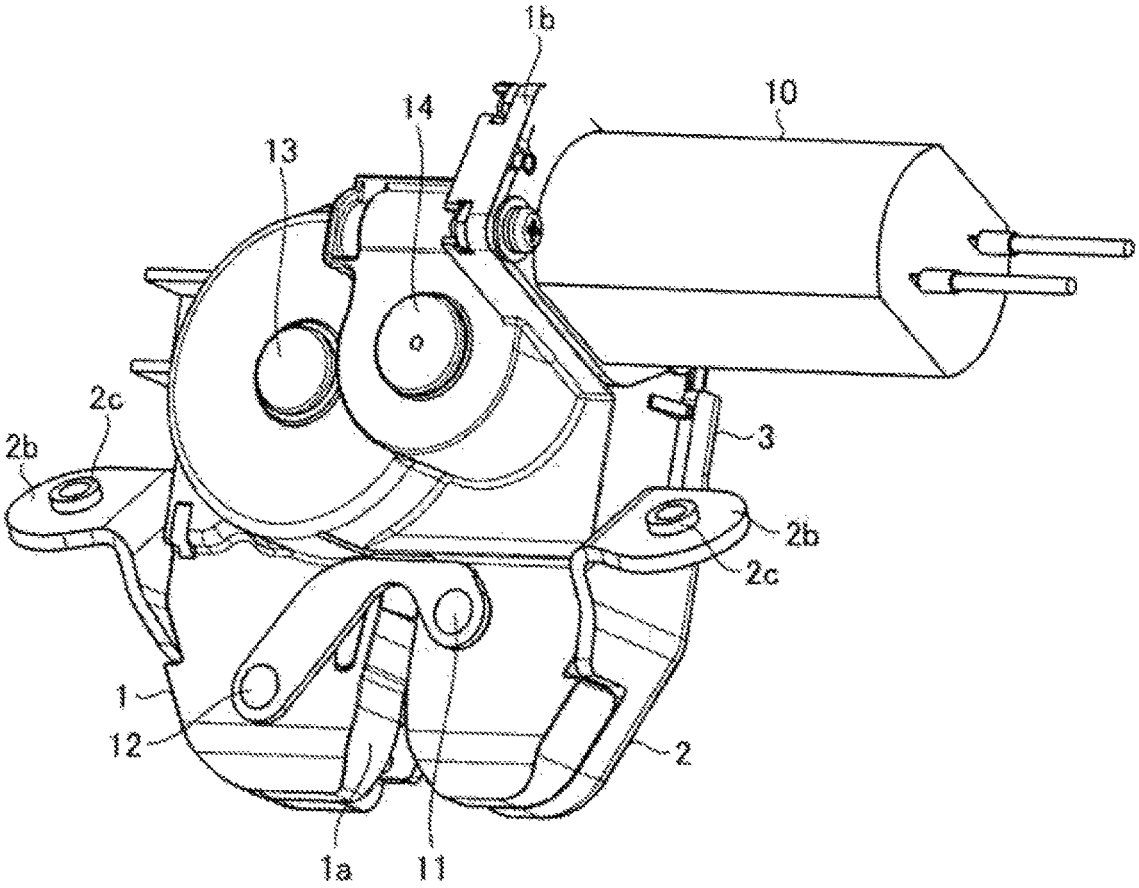
FIG. 1 is a perspective view of an example of a door lock apparatus for describing an embodiment of the invention.

Hereinafter, referring to the drawings, an embodiment will be described.

Figure 2:
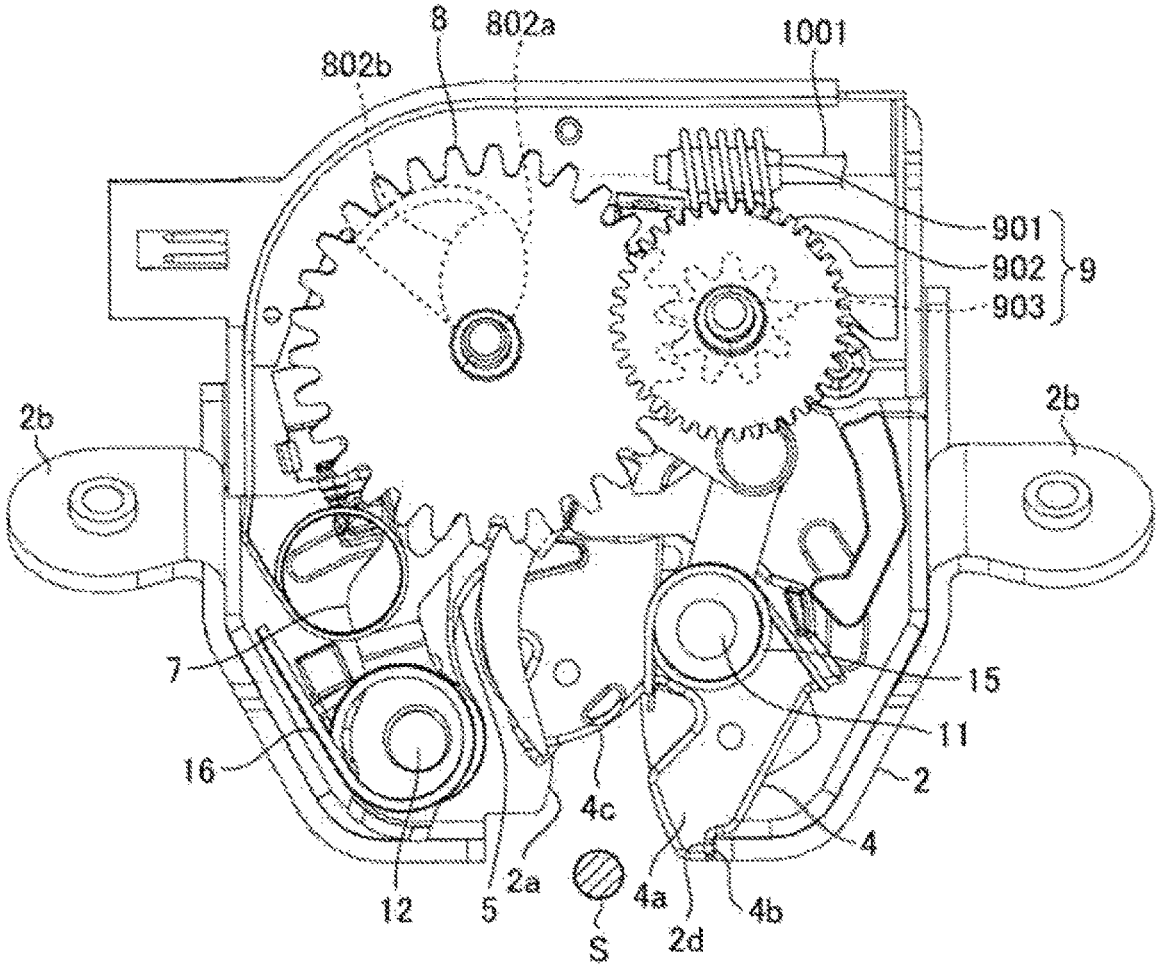
FIG. 2 is a plan view showing an interior configuration of the door lock apparatus shown in FIG. 1.
Figure 3:
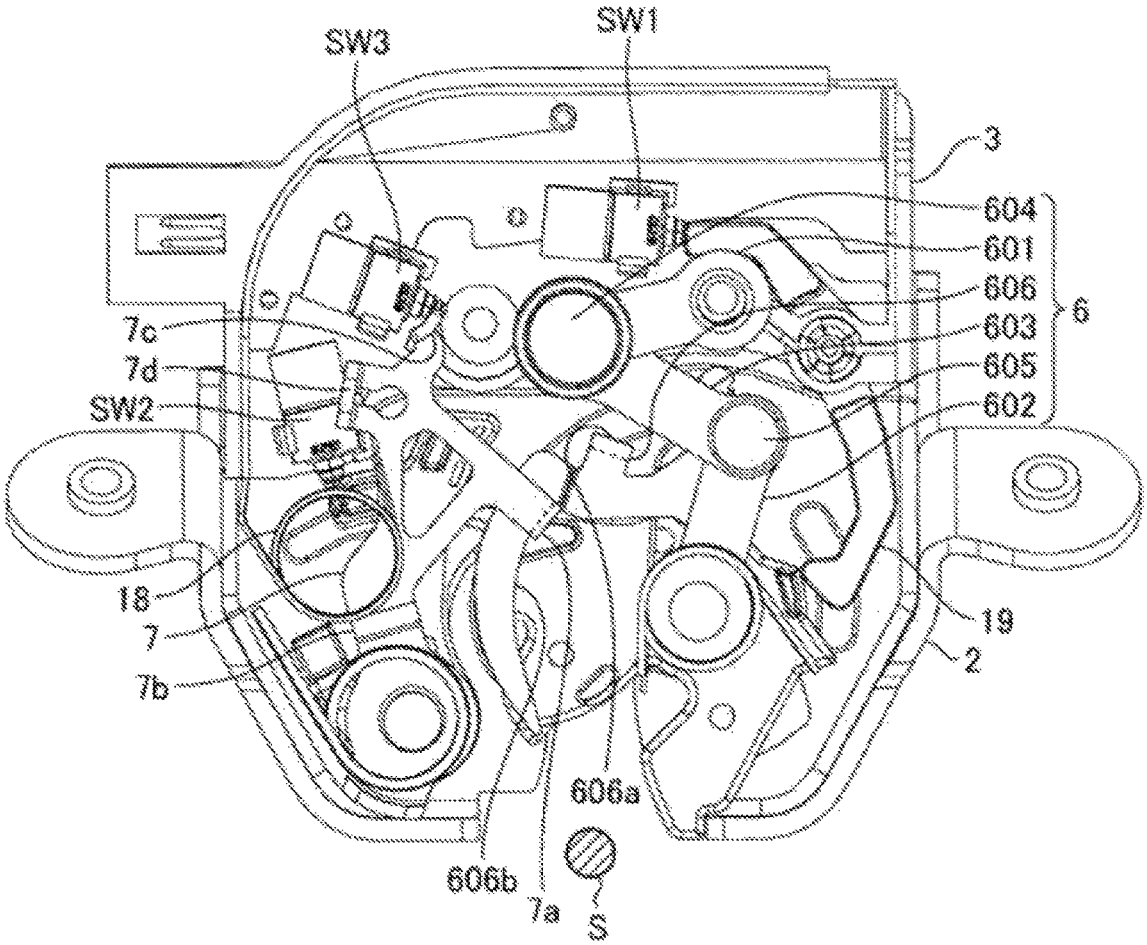
FIG. 3 is a plan view of the door lock apparatus with a reduction gear and a cam gear shown in FIG. 2 omitted from illustration.
Figure 4:
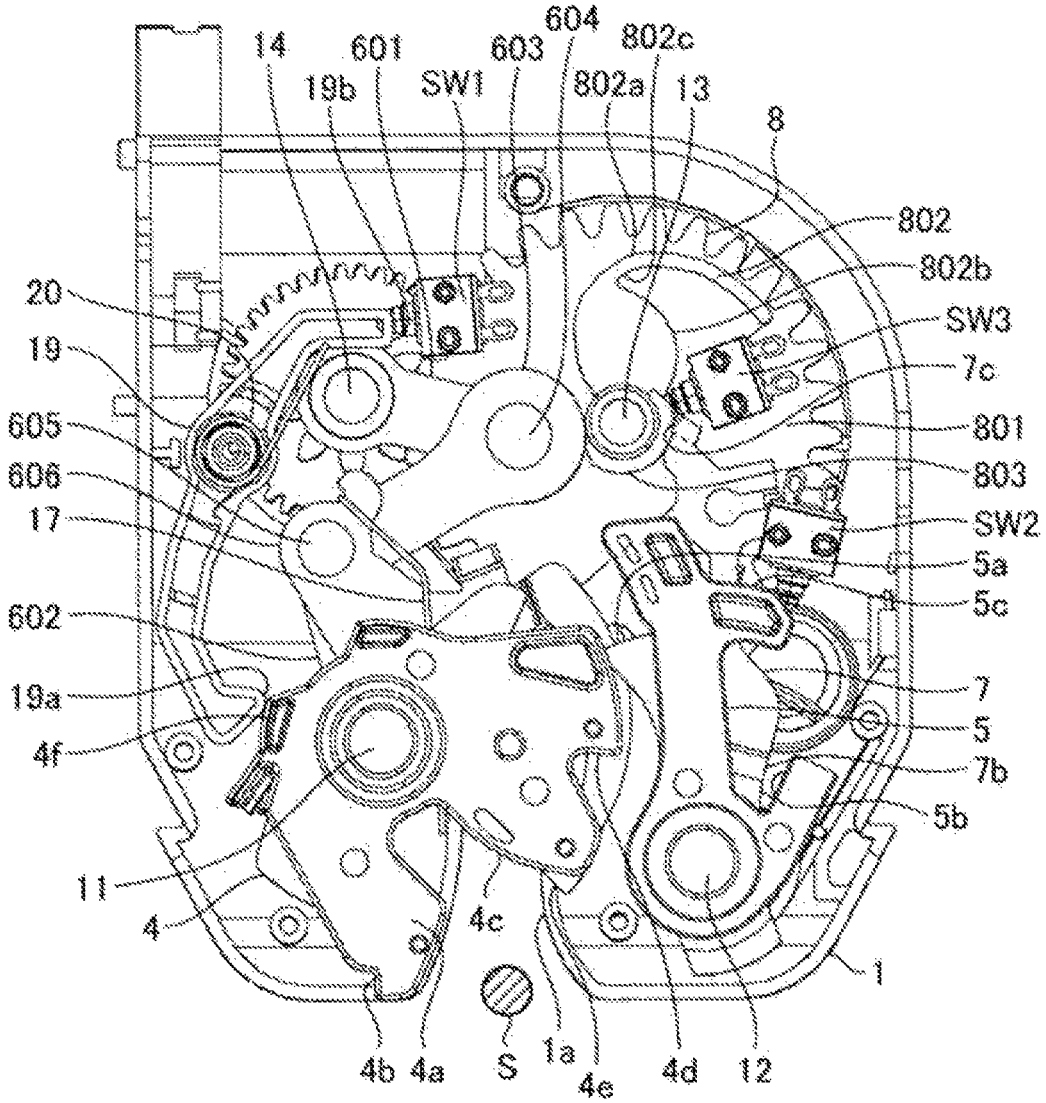
FIG. 4 is a view of the interior configuration of the door lock apparatus shown in FIG. 2 which results when seen from a rear side thereof.
Figure 5:
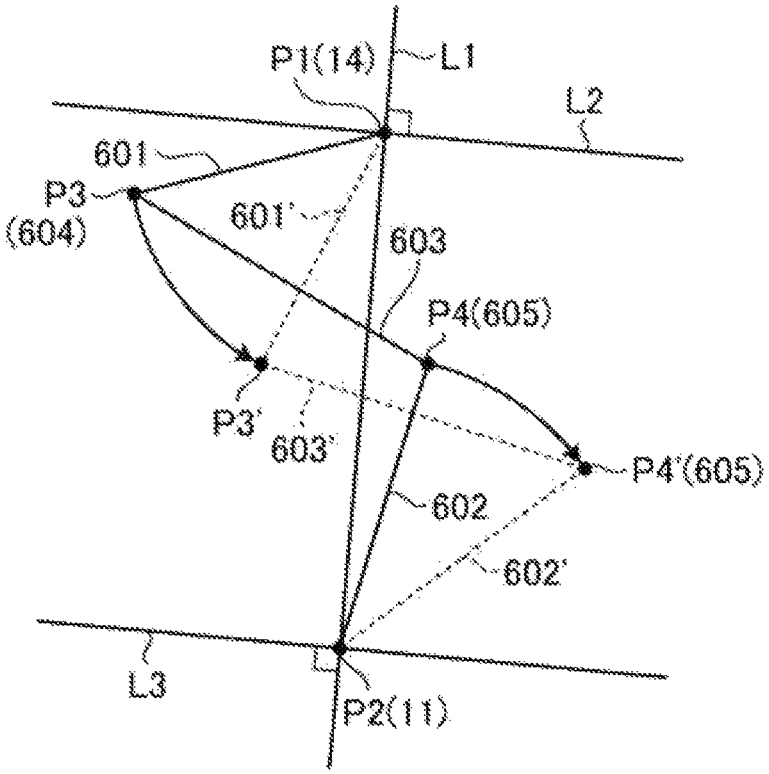
FIG. 5 is a conceptual view showing an operation of a link mechanism of the door lock apparatus shown in FIG. 1.

FIG. 1 is a perspective view of an example of a door lock apparatus for describing an embodiment of the invention. FIG. 2 is a plan view showing an interior configuration of the door lock apparatus shown in FIG. 1. FIG. 3 is a plan view of the door lock apparatus with a reduction gear and a cam gear shown in FIG. 2 omitted from illustration. FIG. 4 is a view of the interior configuration of the door lock apparatus shown in FIG. 2 which results when seen from a rear side thereof. FIG. 5 is a conceptual view showing an operation of a link mechanism of the door lock apparatus shown in FIG. 1.

A door lock apparatus according to this embodiment may be attached to a tailgate or a rear door of a vehicle and holds the tailgate in a closed state by catching a striker provided on a vehicle main body. As shown in FIGS. 1 to 4, this door lock apparatus has a housing which is made up or a case 1, a base plate 2 and a switch plate 3, and a lock mechanism including a latch 4, a ratchet 5 and a lever ratchet 7 and an assisting mechanism including a link mechanism 6, a cam gear 8 and a worm gear 9 are accommodated in the housing. Then, a driving portion 10 which operates the assisting mechanism is attached to the housing.

A striker entrance channel 1*a* which a striker S enters, a passage hole through which one end of a latch shaft 11 is passed, a passage hole through which one end of a ratchet shaft 12 is passed, a passage hole through which one end of a supporting shaft (a revolution shaft) 13 which supports the cam gear 8 is passed, a passage hole through which one end of a supporting shaft (a fixed shaft) 14 which supports a worm wheel 902 of the worm gear 9 is passed, and a fixing portion 1*b* to which the driving portion 10 is fixed are provided on the case 1.

A striker entrance channel 2*a* which the striker S enters, a passage hole through the other end of the latch shaft 11 is passed, a passage hole through which the other end other end of the ratchet shaft 12 is passed, passage holes through which the other ends of the supporting shafts 13, 14 are passed, and attaching portions 2*b* where the door lock apparatus is attached to the tailgate are provided on the base plate 2. Passage holes through which bolts are passed are provided individually in the attaching portions 2*b*, and burring is applied to provide burred portions 2*c* individually on circumferences of the passage holes.

A first switch SW1 for detecting a position of the latch 4, a second switch SW2 for detecting a position of the ratchet 5, a third switch SW3 for detecting a position of the cam gear 8 and wirings connected to these switches SW1 to SW3 are provided on the switch plate 3. The wirings connected to the switches SW1 to SW3 are connected to a control circuit board by way of cables. The first switch SW1, the second switch SW2 and the third switch SW3 are so-called micro-switches and are switched on when their plungers (not shown) are pushed on.

The latch 4 is supported rotatably on the latch shaft 11 and is biased in a counterclockwise direction in FIGS. 2 and 3 (in a clockwise direction in FIG. 4) by a latch spring 15. When the latch 4 is not catching the striker S, the latch 4 is held in an open position where an abutment portion 4*b* which is provided at a distal end of a striker catching portion 4*a* is in abutment with a latch abutment portion 2*d* of the base plate 2. When the striker S enters the striker entrance channels 1*a*, 2*a* with the latch 4 staying in the open position, the strikers presses against a pressure receiving portion 4*c* of the latch 4. The latch 4 which receives a pressing load from the striker S rotates in the counterclockwise direction in FIG. 4, moving towards a full latching position where the latch 4 catches the striker S.

The ratchet 5 is supported rotatably on the ratchet shaft 12 and is biased in the clockwise direction in FIGS. 2 and 3 (in the counterclockwise direction in FIG. 4) by a ratchet spring 16. A latch engaging portion 5*a* is provided on this ratchet 5, and this latch engaging portion 5*a* engages with the latch 4 in such a way as to hold the latch 4 which rotates in the counterclockwise direction in FIG. 4 in a half latching position or the full latching position. When the latch engaging portion 5*a* is brought into engagement with a half latching locking portion 4*d* provided on the latch 4, the latch 4 is held in the half latching position. Additionally, when the latch engaging portion 5*a* is brought into engagement with a full latching locking portion 4*e* provided on the latch 4, the latch 4 is held in the full latching position. On the other hand, the latch 4 moves towards the open position when the ratchet 5 is rotated in the counterclockwise direction in FIG. 4, whereby the engagement between the latch engaging portion 5*a* and the latch 4 is released.

The link mechanism 6 is designed to operate so as to move the latch 4 which has moved from the open position to the half latching position to the full latching position and includes a first link 601, a second ling 602, a middle link 603, a first link shaft 604, a second link shaft 605 and a pull-in lever 606. The first link 601 is supported rotatably on a supporting shaft (a fixed shaft) 14 which is provided on the base plate 2. The second link 602 is supported rotatably on the latch shaft 11. The middle link 603 is connected rotatably to the first link 601 by the first link shaft 604 and is connected rotatably to the second link 602 by the second link shaft 605.

As shown in FIG. 5, the first link 601, the second link 602 and the middle link 603 are arranged into a Z-shaped configuration so that an axis P3 of the first link shaft 604 is positioned in one area bounded by a first plane L1 which includes an axis P1 of the supporting shaft 14 and an axis P2 of the latch shaft 11 (hereinafter, also referred to as a "first area") and an axis P4 of the second link 605 is positioned in the other area bounded by the first plane L1 (hereinafter, also referred to as a "second area"). It should be noted that the supporting shaft 14 and the latch shaft 11 are cylindrical in shape in reality, and the axis P1 of the supporting shaft 14 and the axis P2 of the latch shaft 11 become lines whose lengths correspond to heights of the cylinders. Because of this, the first plane L1 can be defined by three points including two different points on the axis P1 of the supporting shaft 14 and one point on the axis P2 of the latch shaft 11.

Further, the first link 601, the second link 602 and the middle link 603 are arranged so that the ratchet 5 is included in the first area which is bounded by the first plane L1. Namely, the area lying on one side of the first plane L1 as a boundary where the ratchet 5 is positioned is referred to as the first area, and the first link shaft 604 is disposed in this first area.

Lengths of the first link 601, the second link 602 and the middle link 603 are set so that the second link 602 rotates in the clockwise direction in FIG. 5 and moves to a position 602' indicated by a broken line when the first link 601 rotates in the counterclockwise direction in FIG. 5 and moves to a position 601' indicated by a broken line and that an amount of movement of the axis P4 of the second link shaft 605 then (P4 to P4') becomes an amount necessary to move the latch 4 from the half latching position to the full latching position.

Further, the lengths of the first link 601, the second link 602 and the middle link 603 are set so that the axis P3 of the first link shaft 604 and the axis P4 of the second link shaft 605 move within an area held by a second plane L2 and a third plane L3 shown in FIG. 5 therebetween while the latch 4 is moved from the half latching position to the full latching direction. The second plate L2 is a plane which includes the axis P1 of the supporting shaft 14 and which is at right angles to the first plate L1, and the third plane L3 is a plane which includes the axis P2 of the latch shaft 11 and which is at right angles to the first plane L1.

The pull-in lever 606 is designed to be brought into engagement with the latch 4 when the latch 4 is moved from the half latching position to the full latching position and is connected rotatably to the second link shaft 605. The pull-in lever 606 extends from the second link shaft 605 in to the first area while intersecting the first plane L1, and a pull-in portion 606*a* and a cancelling portion 606*b* are provided on the portion of the pull-in lever 606 which extends into the first area. The pull-in portion 606*a* is a portion which is brought into engagement with a pull-in engaging portion 4*g* of the latch 4 when the latch 4 moves from the open position to the half latching position. The cancelling portion 606*b* is a portion which is brought into engagement with the lever ratchet 7 to receive a pressing load from the lever ratchet 7 when releasing the engagement between the pull-in portion 606*a* and the latch 4. Additionally, the cancelling portion 606*b* is provided at a projecting end of the portion of the pull-in lever 606 which extends from the second link shaft 605 in such a way as to form an arc which is centered at the axis of the latch shaft 11 so that the pull-in lever 606 can rotate around the latch shaft 11 together with the second link 602.

The pull-in lever 606 is biased in the counterclockwise direction in FIGS. 2 and 3 (in the counterclockwise direction in FIG. 4) by a coil spring (a link mechanism biasing spring) 17. Namely, the pull-in lever 606 is biased by the coil spring 17 in such a way that a biasing direction of the pull-in lever 606 to rotate about the second link shaft 605 becomes the same as a biasing direction of the latch 4 to rotate about the latch shaft. Additionally, the pull-in portion 606*a* of the pull-in lever 606 is disposed in a position where the pull-in portion 606*a* moves towards the latch shaft 11 when the pull-in lever 606 rotates in the biasing direction. This pull-in lever 606 is held in a position where when the latch 4 stays in the open position, the pull-in portion 606*a* moves away from the latch 4 as a result of a root portion of the cancelling portion 606*b* being brought into engagement with a pull-in lever pressing portion 7*a* of the lever ratchet 7 as shown in FIGS. 3 and 4, while when the latch 4 moves to the half latching position, the pull-in portion 6*a* can be brought into engagement with the pull-in engaging portion 4*g* of the latch 4.

The lever ratchet 7 is designed to release the engagement between the pull-in portion 606*a* of the pull-in lever 606 and the latchet 4 and the engagement between the latch 4 and the ratchet 5 and is supported rotatably on the ratchet shaft 12. The pull-in lever pressing portion 7*a*, a ratchet pressing portion 7*b*, a cam sliding portion 7*c* and a cable connecting portion 7*d* are provided on the lever ratchet 7. The pull-in lever pressing portion 7*a* is brought into engagement with the cancelling portion 606*b* of the pull-in lever 606 to press against the cancelling portion 606*b* in a direction in which the pull-in portion 606*a* moves away from the latch 4 so as to rotate the pull-in lever 606 about the second link shaft 605. The ratchet pressing portion 7*b* is a portion which presses against a pressure receiving portion 5*b* of the ratchet 5 so as to move the ratchet 5 to an engagement releasing position. The cam sliding portion 7*c* is brought into sliding contact with a cam portion 802 of the cam gear 8 when the engagement of the latch 4 with the ratchet 5 is released to receive a pressing load from the cam portion 802. The cable connecting portion 7*d* constitutes a portion to which a cable extending from a manually releasing operation lever is connected when the engagement of the latch 4 with the ratchet 5 is made to be released manually. This lever ratchet 7 is biased in the clockwise direction in FIGS. 2 and 3 (in the counterclockwise direction in FIG. 4) by a coil spring (a lever ratchet biasing spring) 18.

The cam gear 8 is designed to output the power of the driving portion 10 which is transmitted by way of the worm gear 9 to the link mechanism 6 and the lever ratchet 7 and is supported rotatably on the supporting shaft (the revolution shaft) 13. Provided on the cam gear 8 are a gear portion 801, a cam portion 802, and a switch selector portion 803. The gear portion 801 meshes with a reduction gear portion 903 which is provided on the worm wheel 902. The cam portion 802 constitutes a portion which revolves around the supporting shaft 13 as a result of the gear portion 801 rotating and has a first cam surface 802*a* which presses against the first link shaft 604 and the lever ratchet 7 when it revolves around in the counterclockwise direction in FIG. 4 (hereinafter, referred to as a "first direction"), a second cam surface 802*b* which presses against the lever ratchet 7 when revolving around in a second direction which is opposite to the first direction, and a stopper portion 802*c* which is positioned at a terminating end portion of the second cam surface 802*b*. The switch selector portion 803 is a projecting portion which is provided on an outer circumferential surface of a cylindrical portion which projects from the gear portion 801 along the supporting shaft 13 and is provided to switch on or off the third switch SW3.

The cam gear 8 is disposed so that the first link shaft 604 is in a position where the first link shaft 604 overlaps a revolving locus of the cam portion 802 when the latch 4 is in the open position. Both the first cam surface 802*a* and the second cam surface 802*b* are formed into a curved surface defined by spline curves.

The worm gear 9 is designed to transmit the power of the driving portion 10 to the cam gear 8 while reducing the speed thereof and includes a worm 901 which is attached to a rotational shaft 1001 of the driving portion 10, the worm wheel 902 which meshes with the worm 901 and the reduction gear portion 903 which is provided integrally with the worm wheel 902.

With the latch 4 staying in the open position, the cam gear 8 is caused to wait in a first waiting position where the first cam surface 802*a* of the cam portion 802 first presses against the first link shaft 604 when rotating in the first direction (the counterclockwise direction) as shown in FIG. 4. As this occurs, the first switch SW1, the second switch SW2 and the third switch SW3 are all on. The first switch SW1 is switched on and off by a switch lever 19 which is supported rotatably on a supporting shaft (not shown) provided on the switch case 3. With the latch 4 staying in the open position, one end 19*a* of the switch lever 19 is in abutment with a first projecting portion 4*f* of the latch 4, while the other end 19*b* is pressing against the plunger of the first switch SW1. The switch lever 19 is biased in the counterclockwise direction in FIG. 4 by a coil spring 20. The second switch SW2 is switched on and off by a switch selector portion 5*c* of the ratchet 5. With the latch 4 staying in the open position, the switch selector portion 5*c* of the ratchet 5 is pressing against the plunger of the second switch SW2. The third switch SW3 is switched on and off by the switch selector portion 803 of the cam gear 8. With the latch 4 staying in the open position, the switch selector portion 803 of the cam gear 8 is pressing against the plunger of the third switch SW3. It should be noted that the switch selector portion 803 of the cam gear 8 is designed to press against the plunger of the third switch SW3 immediately before the cam portion 802 which revolves around in the first direction arrives at a position shown in FIG. 4.

When the tailgate is closed with the latch 4 staying in the open position, the striker S enters the striker entrance channels 1*a*, 2*a* to press against the pressure receiving portion 4*c* of the latch 4. The latch 4 which receives the pressing load from the striker S rotates in the counterclockwise direction in FIG. 4 and moves towards the half latching position.

Figure 6:
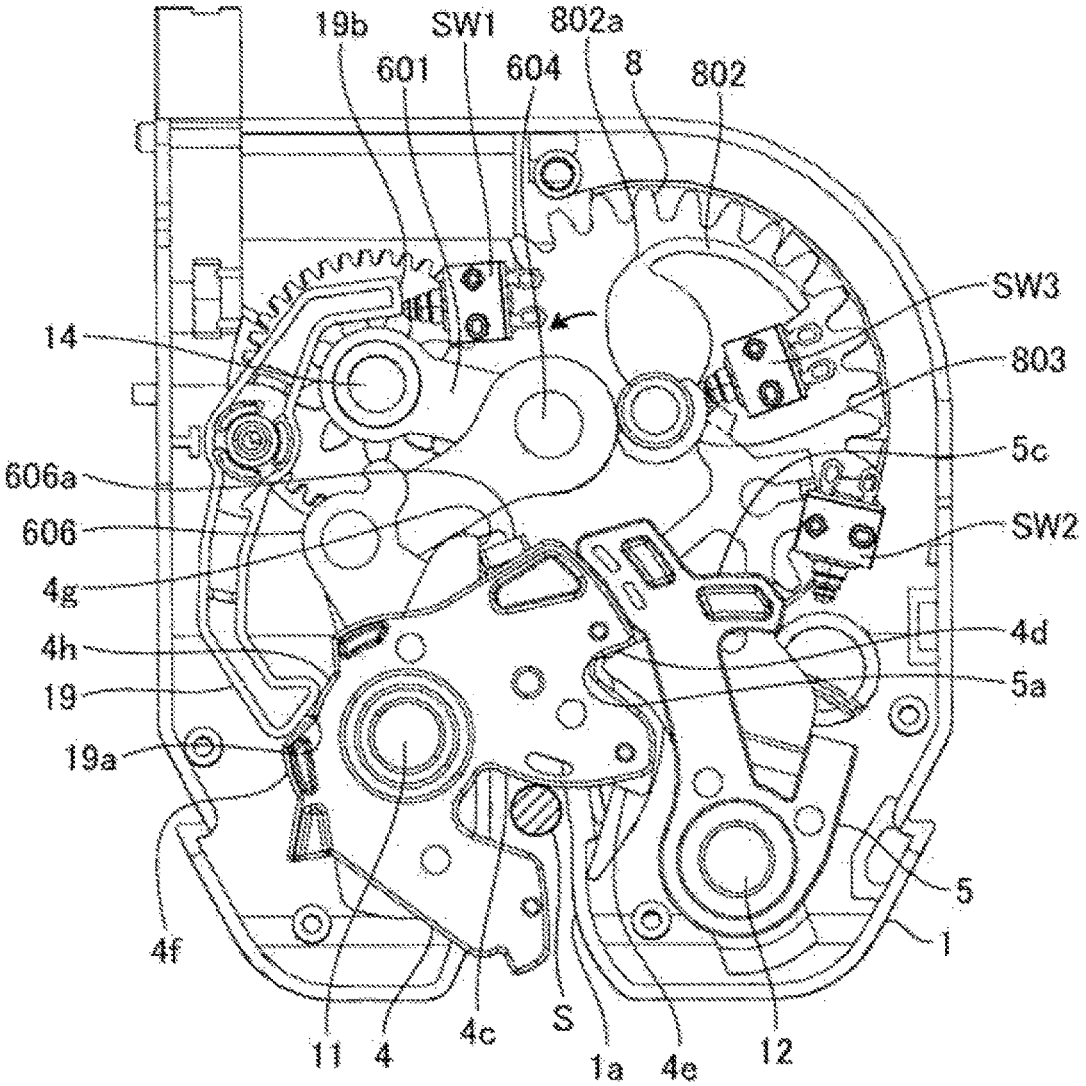
FIG. 6 is a view showing an interior configuration of the door lock apparatus which results when a latch moves from an open position to a half latching position.
Figure 7:
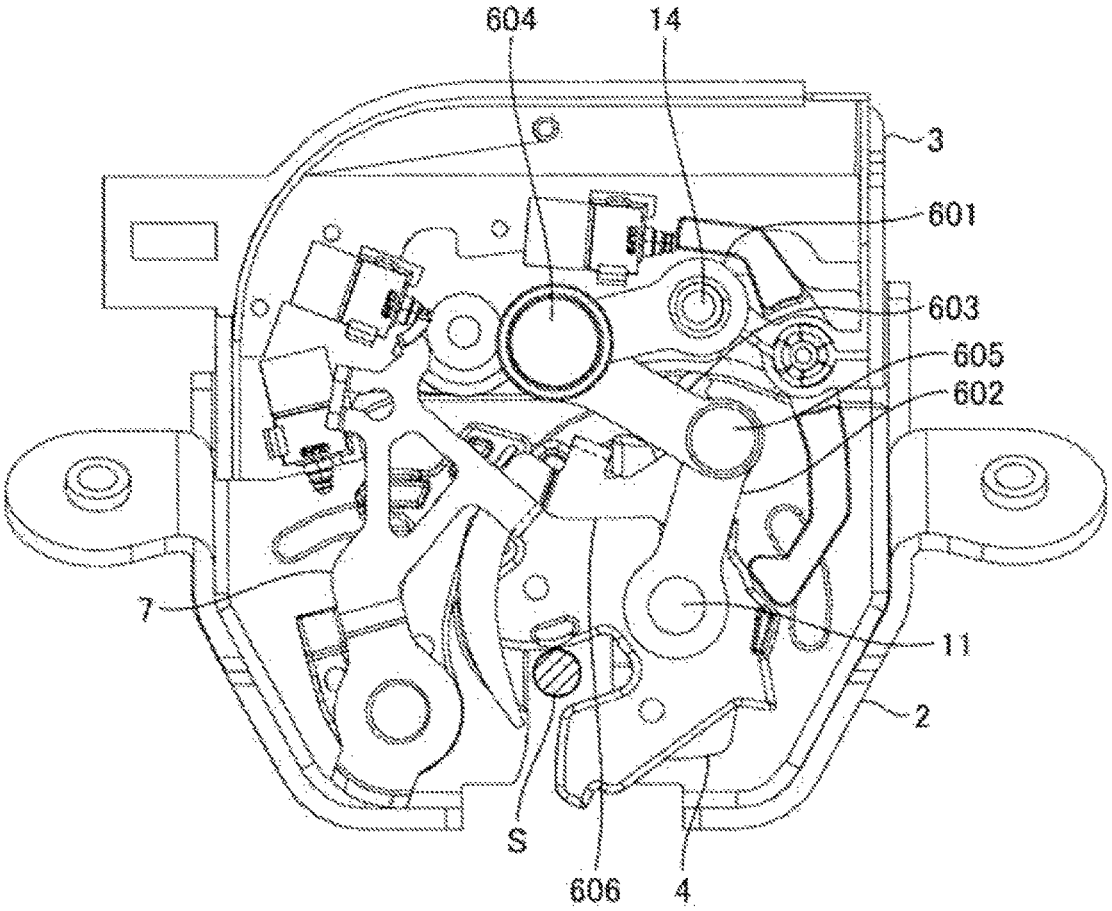
FIG. 7 is a view of the interior configuration of the door lock apparatus shown in FIG. 6 which results when seen from the rear side thereof.
Figure 8:
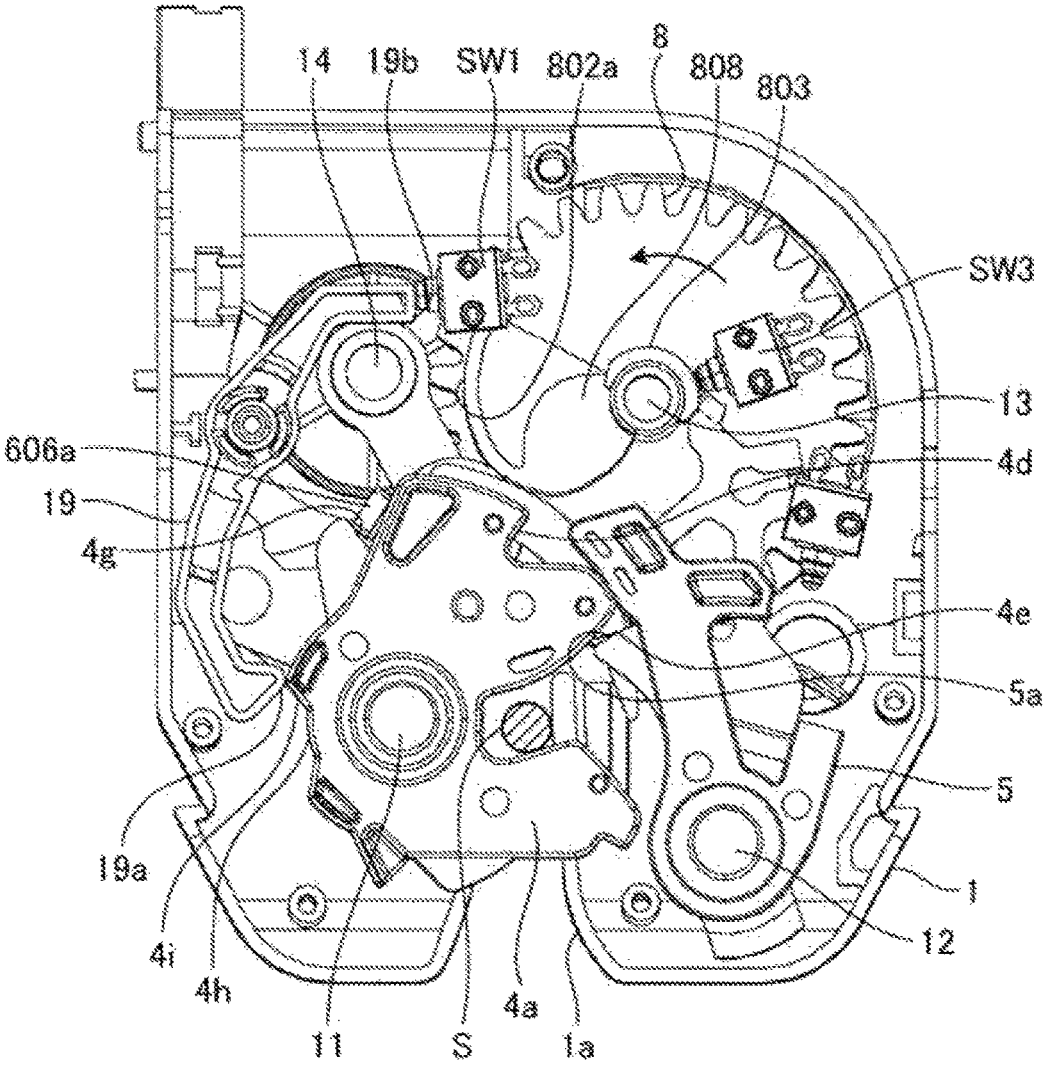
FIG. 8 is a view showing an interior configuration of the door lock apparatus which results when the latch moves to a full latching position.
Figure 9:
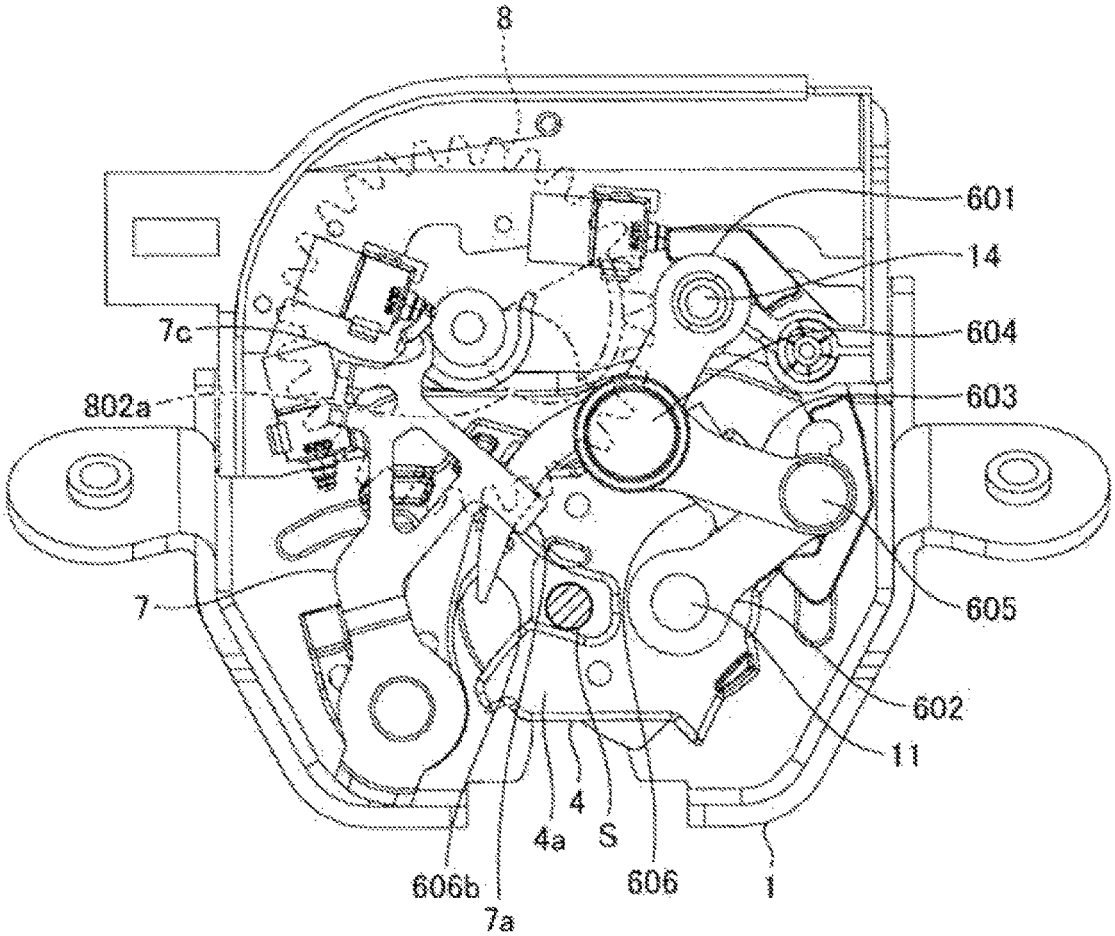
FIG. 9 is a view of the interior configuration of the door lock apparatus shown in FIG. 8 which results when seen from the rear side thereof.
Figure 10:
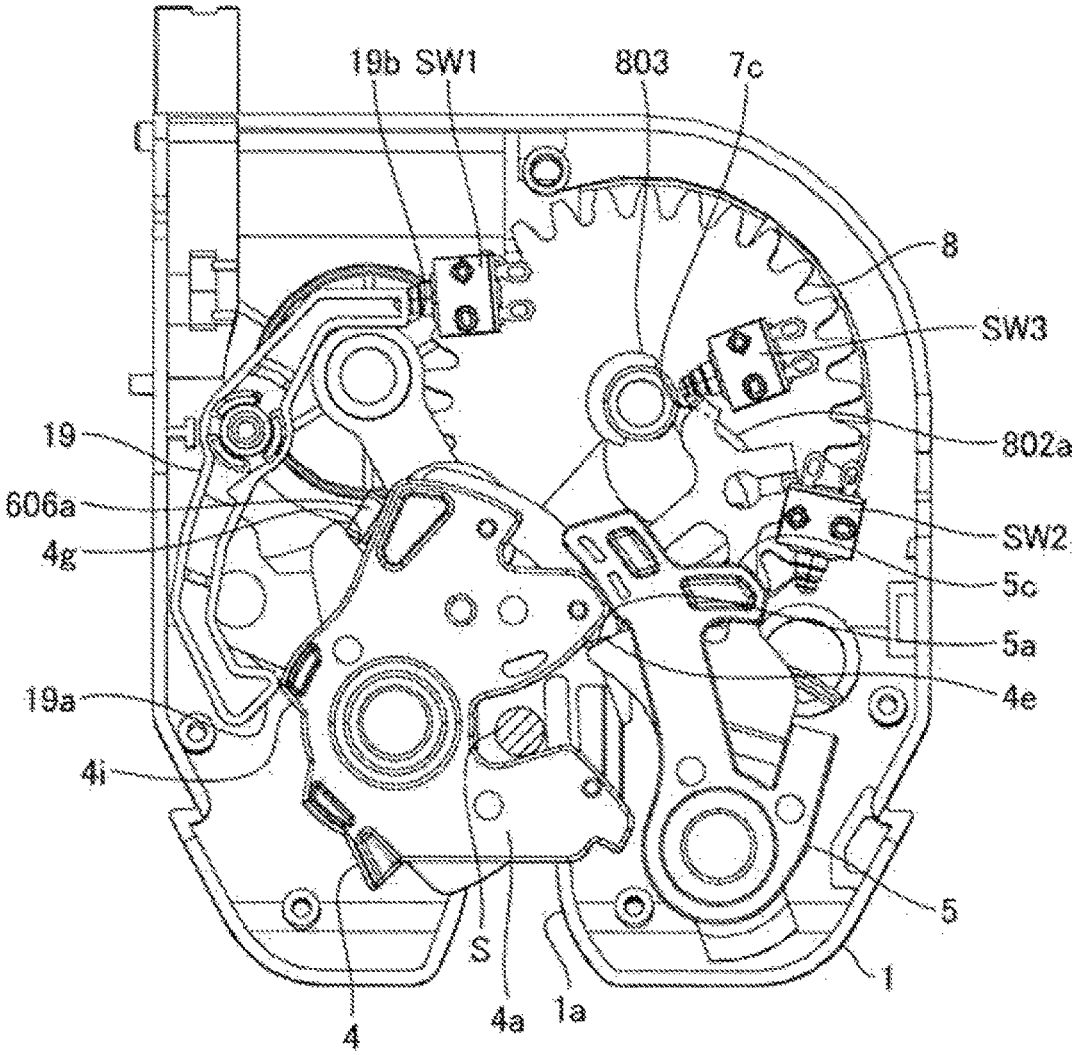
FIG. 10 is a view showing an interior configuration of the door lock apparatus which results after an operation of pulling the latch into the fully latching position is completed.
Figure 11:
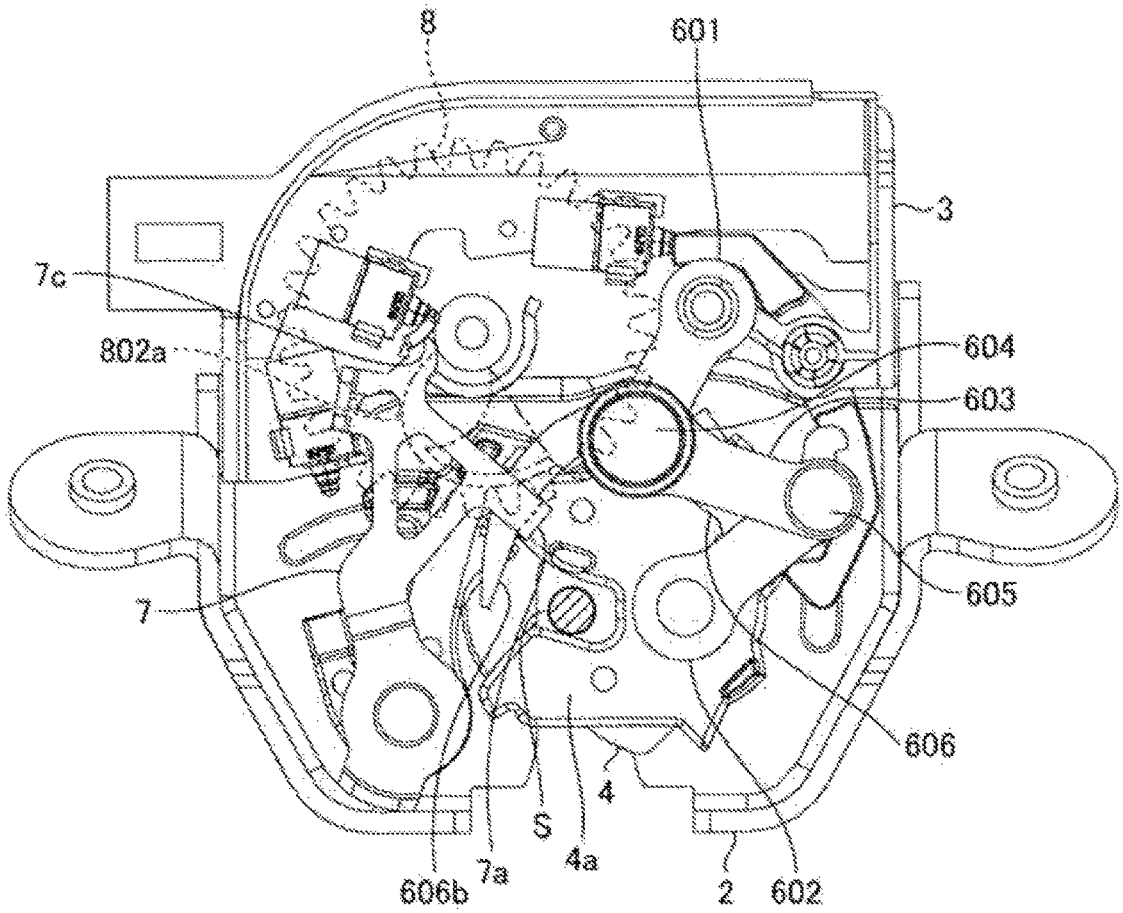
FIG. 11 is a view of the interior configuration of the door lock apparatus shown in FIG. 10 which results when seen from the rear side thereof.

FIG. 6 is a view showing an interior configuration of the door lock apparatus which results when the latch moves from the open position to the half latching position. FIG. 7 is a view of the interior configuration of the door lock apparatus shown in FIG. 6 which results when seen from the rear side thereof. FIG. 8 is a view showing an interior configuration of the door lock apparatus which results when the latch moves to the full latching position. FIG. 9 is a view of the interior configuration of the door lock apparatus shown in FIG. 8 which results when seen from the rear side thereof. FIG. 10 is a view showing an interior configuration of the door lock apparatus which results after an operation of pulling the latch into the fully latching position is completed. FIG. 11 is a view of the interior configuration of the door lock apparatus shown in FIG. 10 which results when seen from the rear side thereof. It should be noted that FIGS. 6, 8 and 10 show the views resulting when seen in the same direction as the direction in which the view shown in FIG. 4 is seen and that FIGS. 7, 9 and 11 shows the views resulting when seen in the same direction as the direction in which the view in FIG. 3 is seen.

The abutting position on the latch 4 with the end 19*a* of the switch lever 19 changes from the first projecting portion 4*f* to a recess portion 4*h* in the midst of the latch 4 moving from the open position to the half latching position. Since a distance from the latch shaft 11 to the recess portion 4*h* is shorter than a distance from the latch 11 to the projecting portion 4*f*, the switch lever 19 rotates in the counterclockwise direction in FIG. 6. This causes the other end 19*b* of the switch lever 19 to move away from the plunger of the first switch SW1, whereby the first switch SW1 is switched off from on. Additionally, when the latch 4 moves towards the half latching position, a projecting portion (not shown) which lies adjacent to the pull-in engaging portion 4*g* of the latch 4 presses against the pull-in portion 606*a* of the pull-in lever 606 to cause the pull-in lever 606 to rotate about the second link shaft 605. As this occurs, the pull-in lever 606 rotates in an opposite direction to the direction in which the pull-in lever 606 is biased by the coil spring 17.

Then, when the latch 4 arrives at the half latching position, as shown in FIGS. 6 and 7, the half latching locking portion 4*d* of the latch 4 is brought into engagement with the latch engaging portion 5*a* of the ratchet 5, and the pull-in portion 606*a* of the pull-in lever 606 is brought into engagement with the pull-in engaging portion 4*g* of the latch 4. As this occurs, the ratchet 5 rotates in the counterclockwise direction in FIG. 6, whereby the switch selector portion 5*c* of the ratchet 5 moves away from the plunger of the second switch SW2. This shifts the second switch SW2 from on to off. When the latch 4 arrives at the half latching position, whereby the first switch SW1 and the second switch SW2 are switched off, while the third switch SW3 is switched on, the control circuit operates the driving portion 10 so that the cam gear 8 rotates in the first direction from the first waiting position.

When the cam gear 8 rotates in the first direction from the first waiting position, the first cam surface 802*a* of the cam portion 802 presses against the first link shaft 604, and the first link 601 rotates in the clockwise direction in FIG. 6 about the supporting shaft 14. As the first link 601 rotates, the link mechanism 6 is actuated to operate, and the second link 602 rotates in the counterclockwise direction in FIG. 6 about the latch shaft 11, that is, in the same direction as the direction when the latch 4 moves from the half latching direction to the full latching direction. When the second link 602 rotates, the pull-in lever 606 which is connected to the second link 602 by way of the second link shaft 605 also rotates in the counterclockwise direction in FIG. 6 about the latch shaft 11. As this occurs, the pull-in lever 606 which is biased by the coil spring 17 rotates in such a state that the engagement of the pull-in portion 606*a* with the pull-in engaging portion 4*g* of the latch 4 is maintained. Because of this, the pull-in portion 606*a* of the pull-in lever 606 presses against the latch 4 by way of the pull-in engaging portion 4*g* towards the full latching position, whereby the latch 4 moves towards the full latching position.

The latch 4 has a section whose distance from the latch shaft 11 becomes longer as it extends towards the full latching locking portion 4*e* between the half latching locking portion 4*d* and the full latching locking portion 4*e* on a side surface which slides on the ratchet 5. Because of this, the ratchet 5 rotates in the clockwise direction in FIG. 8 in the midst of the latch 4 moving from the half latching position to the full latching position, and the switch selector portion 5*c* of the ratchet 5 presses against the plunger of the second switch SW2. This shifts the second switch SW2 from off to on. Additionally, the abutting position on the latch 4 with the end 19*a* of the switch lever 19 changes from the recess portion 4*h* to a second projecting portion 4*i* in the midst of the latch 4 moving from the half latching position to the full latching position. Since a distance from the latch shaft 11 to the second projecting portion 4*i* is longer than a distance from the latch shaft 11 to the recess portion 4*h*, the switch lever 19 rotates in the clockwise direction in FIG. 8. This causes the other end 19*b* of the switch lever 19 to presses against the plunger of the first switch SW1, whereby the first switch SW1 is shifted from off to on.

Then, when the latch 4 arrives at the full latching position, the full latching engaging portion 4*e* of the latch 4 is brought into engagement with the latch engaging portion 5*a* of the ratchet 5. As this occurs, the ratchet 5 rotates in the counterclockwise direction in FIG. 6, and the switch selector portion 5*c* of the ratchet 5 moves away from the plunger of the second switch SW2, whereby the second switch SW2 is shifted from on to off.

Thereafter, when the cam gear 8 rotates further in the first direction and the first cam surface 802*a* of the cam portion 802 moves away from the first link shaft 604 as shown in FIGS. 10 and 11, the switch selector portion 803 of the cam gear 8 moves away from the plunger of the third switch SW3, whereby the third switch SW3 is shifted from on to off. When the latch 4 arrives at the full latching position, whereby the first switch SW1 is switched on, while the second switch SW2 and the third switch SW3 are switched off, the control circuit board stops the driving portion 10. This stops the cam gear 8, and as shown in FIGS. 10 and 11, the cam gear 8 waits in a second waiting position where the first cam surface 802*a* of the cam portion 802 first presses against the cam sliding portion 7*c* of the lever ratchet 7 when the cam gear 8 rotates in the first direction. As a result, the striker S is caught by the striker catching portion 4*a* of the latch 4 which runs across the striker entrance channels 1*a*, 2*a*, whereby the tailgate is held in a closed state.

Figure 12:
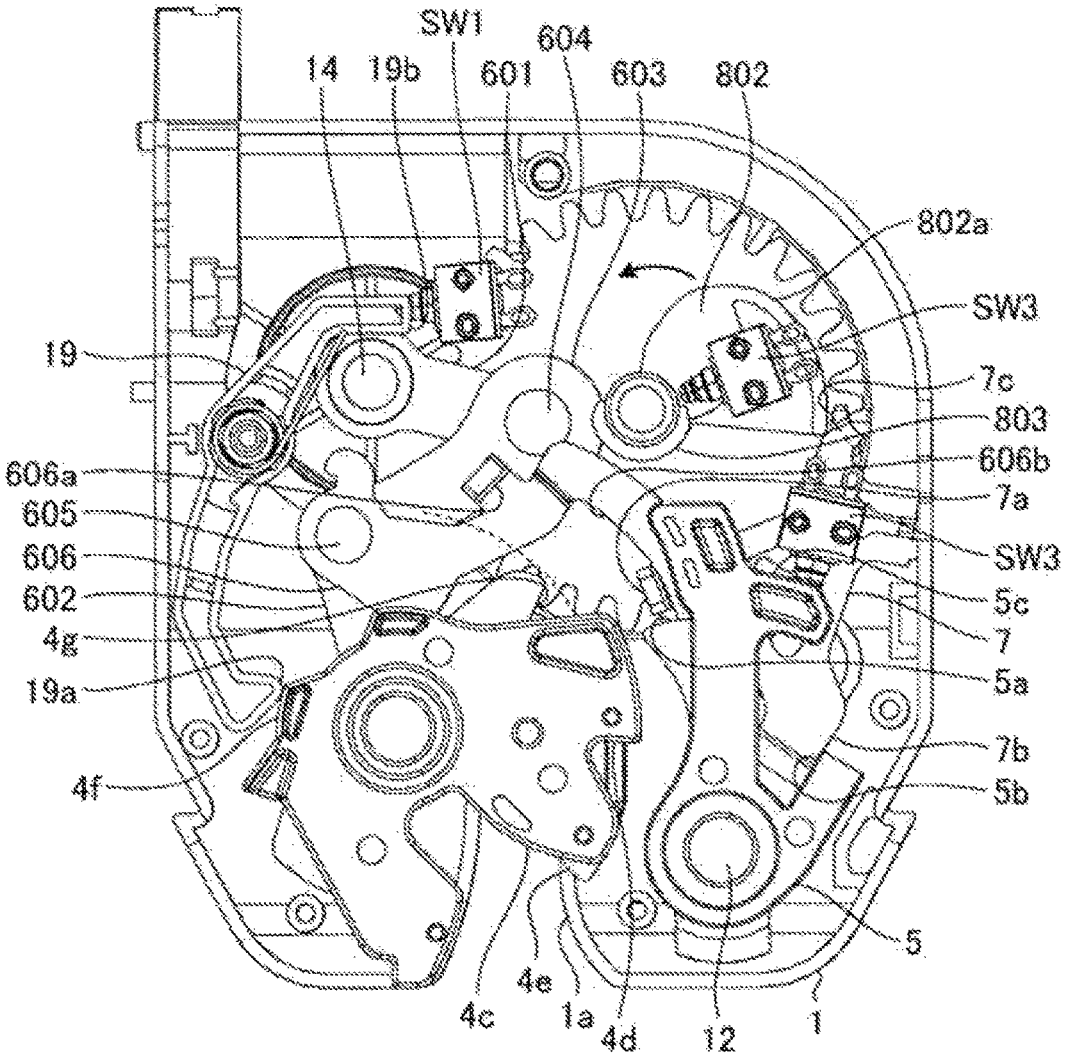
FIG. 12 is a view showing an interior configuration of the door lock apparatus when a door is operated to be opened.

FIG. 12 is a view showing an interior configuration of the door lock apparatus when the door is operated to be opened.

It should be noted that FIG. 12 shows the view which is seen in the same direction as the direction in which the view of FIG. 10 is seen.

When an open-the-tailgate button provided inside a passenger compartment is depressed with the latch 4 held in the full latching position and the cam gear 8 waiting in the second waiting position, the control circuit board operates the driving portion 10 so as to rotate the cam gear 8 in the first direction. When the cam gear 8 rotates in the first direction from the second waiting position, the first cam surface 802*a* of the cam portion 802 presses against the cam sliding portion 7*c* of the lever ratchet 7, and the lever ratchet 7 rotates about the ratchet shaft 12 in the clockwise direction in FIG. 10. As this occurs, the pull-in lever pressing portion 7*a* of the lever ratchet 7 presses against the cancelling portion 606*b* of the pull-in lever 606, and as shown in FIG. 12, the pull-in lever 606 rotates about the second link shaft 605 in the counterclockwise direction in FIG. 12. This causes the pull-in portion 606*a* of the pull-in lever 606 to rotate about the second link shaft 605 in a direction in which the pull-in portion 606*a* moves away from the latch 4, whereby the engagement of the pull-in portion 606*a* with the pull-in engaging portion 4*g* of the latch 4 is released. Additionally, at the same time as the release of the engagement between the pull-in portion 606*a* and the pull-in engaging portion 4*g*, the ratchet pressing portion 7*b* of the lever ratchet 7 presses against the pressure receiving portion 5*b* of the ratchet 5, causing the ratchet 5 to move in an engagement releasing position, whereby the engagement of the latch engaging portion 5*a* of the ratchet 5 with the full latching engaging portion 4*e* of the latch 4 is released. This causes the latch 4 to move to the open position, whereby the striker S is released, allowing the tailgate to be opened.

Thereafter, when the cam gear 8 rotates further in the first direction, causing the first cam surface 802*a* of the cam portion 802 to move away from the cam sliding portion 7*c* of the lever ratchet 7, the lever ratchet 7 rotates about the ratchet shaft 12 in the counterclockwise direction in FIG. 12 to return to its position shown in FIG. 4. When the lever ratchet 7 returns to the position shown in FIG. 4, the ratchet 7 also returns to its position shown in FIG. 4. Additionally, when the lever ratchet 7 returns to its position shown in FIG. 4, the pull-in lever 606 which is biased by the coil spring 17 returns to its position shown in FIG. 4 while rotating about the second link shaft 605. As this occurs, the second link shaft 605 rotates in an opposite direction to the direction in which the second link shaft 605 rotates when moving the latch 4 to the full latching position. Namely, the coil spring (the link mechanism biasing spring) 17 biases the first link 603 via the pull-in lever 606 and the like in an opposite direction to the direction in which the first link 603 moves when moving the latch 4 to the full latching direction. Because of this, when the lever ratchet 7 returns to its position shown in FIG. 4, the link mechanism 6 also returns to its position shown in FIG. 4. Namely, the coil spring 17 biases not only the pull-in lever 606 but also the whole of the link mechanism 6.

The first switch SW1 and the second switch SW2 are switched on when the latch 4 moves from the full latching position to the open position. Then, when the cam gear 8 rotates in the first direction, causing the switch selector portion 803 to press against the plunger of the third switch SW3, the third switch SW3 is shifted from off to on. In this way, when the first switch SW1 and the second switch SW2 are switched on and the third switch SW3 is shifted from off to on, the control circuit board stops the driving portion 10. This stops the cam gear 8 in the first waiting position, and the door lock apparatus returns from the state shown in FIG. 2 to the state shown in FIG. 4.

With the door lock apparatus of this embodiment, also when the lever ratchet 7 is moved directly to open the tailgate without rotating the cam gear 8 which stays in the second waiting position, the engagement of the latch 4 with the ratchet 5 and the engagement of the latch 4 with the pull-in lever 606 can be released. As this occurs, when the ratchet 5 moves to an engagement releasing position and the second switch SW2 is switched on, the control circuit board operates the driving portion 10 so as to rotate the cam gear 8 in the first direction. Then, when the cam gear 8 arrives at the first waiting position shown in FIG. 4 and the third switch SW3 is switched on, the driving portion 10 stops, whereby the rotation of the cam gear 8 is stopped.

Figure 13:
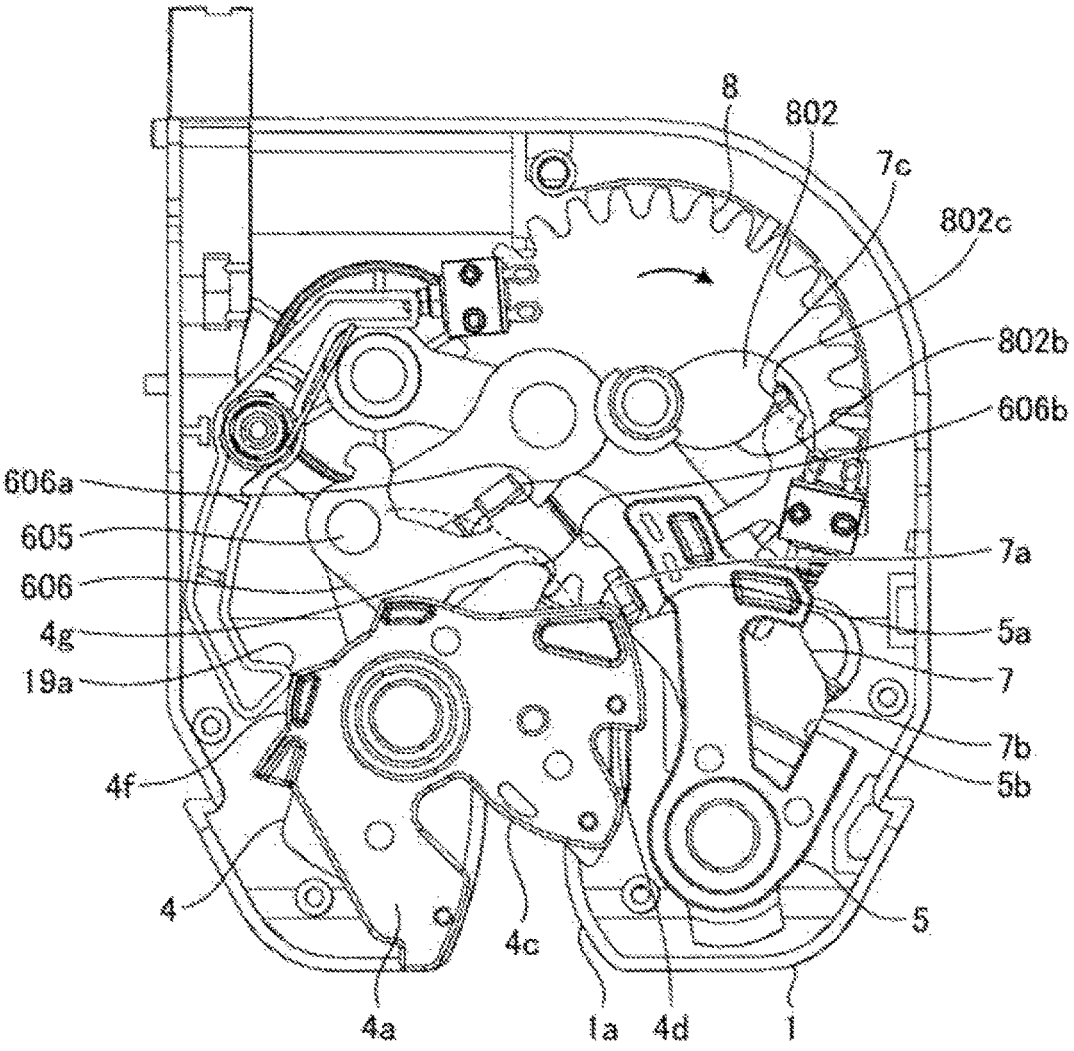
FIG. 13 is a view of the door lock apparatus shown in FIG. 1 which describes a different operation thereof.

FIG. 13 is a view of the door lock apparatus according to this embodiment which describes a different operation thereof. It should be noted that FIG. 13 shows the view resulting when seen from the same direction as the direction in which the view shown in FIG. 8 is seen.

There are fears that a situation is caused in which a foreign matter such as part of the clothes of an occupant or a piece of luggage is caught between the tailgate and the vehicle main body when the tailgate is closed, preventing the latch 4 from being pulled into the full latching position. In the event that such a situation is caused, the cam gear 8 stops extraordinarily in the midst of moving the latch 4 to the full latching position, whereby the tailgate is kept closed incompletely with the latch 4 held between the half latching position and the full latching position.

With the door lock apparatus of this embodiment, in a case where the cam gear 8 stops extraordinarily in the midst of moving the latch 4 to the full latching position, the driving portion 10 is rotated reversely so as to rotate the cam gear 8 in the second direction. When the cam gear 8 is rotated in the second gear so as to cause the first cam surface 802*a* of the cam portion 802 to move away from the first link shaft 604, the latch 4 is held in the half latching position. When the cam gear 8 is rotated further in the second direction in that state, as shown in FIG. 13, the second cam surface 802*b* provided on the cam portion 802 presses against the cam sliding portion 7*c* of the lever ratchet 7, and therefore, the lever ratchet 7 and the ratchet 5 rotate in the clockwise direction in FIG. 13. This releases the engagement of the latch 4 with the ratchet 5 and the engagement of the latch 4 with the pull-in portion 606*a* of the pull-in lever 606, allowing the latch 4 to move to the open position.

When the cam sliding portion 7*c* of the lever ratchet 7 arrives at the terminating end portion of the second cam surface 802*b*, the cam sliding portion 7*c* is brought into abutment with the stopper portion 802*c* of the cam portion 802 to thereby restrict the cam gear 8 from rotating in the second direction. When the rotation of the cam gear 8 is restricted, the driving portion 10 is again rotated reversely and the cam gear 8 is rotated in the first direction. Then, when the cam gear 8 arrives at the first waiting position shown in FIG. 4, the driving portion 10 stops, and the rotation of the cam gear 8 is stopped. By doing so, in the event that the situation is caused in which the tailgate is kept in the incompletely closed state where the latch 4 is held between the half latching position and the full latching position, the tailgate can be opened quickly to be reclosed properly.

In the door lock apparatus of this embodiment, as shown in FIG. 5, the middle link 603 of the link mechanism 6 intersects the first plane L1 which includes the supporting shaft 14 and the latch shaft 11. An occupied area by the link mechanism 6 which is configured in the way described above becomes a sum of a substantially triangular area lying on the first area side and a substantially triangular area lying on the second area side. In contrast with this, in a case where the first link 601, the second link 602 and the middle link 603 are disposed on the second area side without changing the lengths of the first link 601, the second link 602 and the middle link 603 and the moving range of the second link shaft 605, an occupied area by the resulting link mechanism takes a substantially quadrangular shape and becomes larger than the occupied area by the link mechanism 6 of this embodiment. Namely, with the link mechanism 6 of this embodiment, the occupied area by the link mechanism 6 can be made small without changing the lengths of the first link 601, the second link 602 and the middle link 603 and the moving range of the second link shaft 605.

In the link mechanism 6 of this embodiment, the first link 601, the second link 602 and the middle link 603 are arranged into the Z-shaped configuration. Because of this, a distance between the axis P1 of the supporting shaft (the fixed shaft) 14 and the axis P2 of the latch shaft 11 can be made short while ensuring the moving amount of the second link shaft 605 which is necessary to allow the latch 4 to move from the half latching position to the full latching position. In addition, by disposing the first link shaft 604 which receives the power from the cam gear 8 (the driving member) in the area bounded by the first plane L1 where the ratchet 5 is disposed, the cam gear 8 can be disposed on the side of the link mechanism 6 where the ratchet 5 is provided. By adopting this configuration, a depth-wise dimension (a dimension in a direction in which the striker S enters or retreats) of the door lock apparatus which is necessary for arrangement of the link mechanism 6 and the cam gear 8 can be reduced, thereby making it possible to make the door lock apparatus small in size.

In the door lock apparatus of this embodiment, the first link shaft 604 and the second link shaft 605 move between the second plane L2 which passes through the axis P1 of the supporting shaft 14 and which is at right angles the first plane L1 and the third plane L3 which passes through the axis P2 of the latch shaft 11 and which is at right angles to the first plane L1. Because of this, the dimension following the direction of the line which connects the axis P1 of the supporting shaft 14 and the axis P2 of the latch shaft 11 becomes the distance between the axis P1 of the supporting shaft 14 and the axis P2 of the latch shaft 11, thereby making it possible to reduce more the depth-wise dimension of the door lock apparatus.

Further, in the door lock apparatus of this embodiment, the cam portion 802 is caused to revolve around the supporting shaft 13, and the first link shaft 604 is made to lie within the revolving locus of the cam portion 802 when the latch 4 stays in the open position. Because of this, the supporting shaft (the revolution shaft)13 which supports the cam gear 8 can be disposed near the first link 601, thereby making it possible to prevent the door lock apparatus from being enlarged in size in a widthwise direction (a direction which is at right angles to the depth-wise direction).

The lever ratchet 7 which is supported rotatably on the ratchet shaft 12 and which has the ratchet pressing portion 7*b* and the cam sliding portion 7*c* is disposed on the area bounded by the first plane L1 where the ratchet 5 is disposed. This enables the ratchet 5 to move to the engagement releasing position by the use of the cam portion 802 which operates the link mechanism 6. Because of this, the engagement of the latch 4 with the ratchet 5 can be released by means of the power from the driving portion 10, and the engagement releasing configuration can be simplified.

The pull-in lever 606 which moves the latch 4 from the half latching position to the full latching position is connected rotatably to the second link shaft 605 and is caused to extend from the second link shaft 605 into the first area where the ratchet 5 is disposed, and the pull-in portion 606*a* and the cancelling portion 606*b* are provided on the portion of the pull-in lever 606 which extends in the first area. This pull-in lever 606 is biased by the coil spring 17 so that the biasing direction of the pull-in lever 606 around the second link shaft 605 becomes the same as the biasing direction of the latch 4 around the latch shaft 11. The pull-in portion 606*a* of the pull-in lever 606 is disposed in the position where the pull-in portion 606*a* moves towards the latch shaft 11 as the pull-in lever 606 rotates in the biasing direction. Because of this, the engagement of the pull-in portion 606*a* of the pull-in lever 606 with the pull-in engaging portion 4*g* of the latch 4 can be made and released by causing the pull-in lever 606 to rotate about the second link shaft 605. Additionally, the cancelling portion 606*b* of the pull-in lever 606 is in engagement with the pull-in lever pressing portion 7*a* of the lever ratchet 7, and the pull-in lever pressing portion 7*a* presses against the cancelling portion 606*b* in an opposite direction to the biasing direction of the pull-in lever 606 when the lever ratchet 7 moves the ratchet 5 to the engagement releasing position. This causes the pull-in portion 606*a* of the pull-in lever 606 to move away from the pull-in engaging portion 4*g* of the latch 4. Because of this, the engagement of the latchet 4 with the pull-in lever 606 can also be released by the lever ratchet 7 which releases the engagement of the latch 4 with the ratchet 5. Consequently, the configuration for releasing the engagement of the latch 4 with the pull-in lever 606 can be simplified, thereby making it possible to prevent the enlargement in size of the door lock apparatus.

Further, the pull-in lever 606 rotates not only about the second link shaft 605 but also about the latch shaft 11 when the link mechanism 6 operates. As this occurs, the pull-in portion 606*a* of the pull-in lever 606 which is in engagement with the pull-in engaging portion 4*g* of the latch 4 moves along the moving direction of the latch 4 (the pull-in engaging portion 4*g*). This enables the pull-in lever 606 to move efficiently when the link mechanism 6 operates, whereby the latch 4 can be moved to the full latching position.

The cam portion 802 of the cam gear 8 can move circumferentially when the cam portion 802 revolves around in the first direction, and the first cam portion 802*a* is pressed against the first link shaft 604 and the cam sliding portion 7*c* of the lever ratchet 7 individually once before the cam portion 802 completes a full circumferential movement in the first direction. Because of this, the operation of moving the latch 4 from the half latching position to the full latching position and the operation of moving the latch 4 from the full latching position to the open position can be executed by causing the cam gear 8 to revolve in the first direction while stopping the rotation of the cam gear 8 to cause it to wait in the waiting positions at a point in time when the latch 4 moves to the full latching position and at a point in time when the latch 4 moves to the open position. In addition, the second cam surface 802*b* is provided on the cam portion 802, and this second cam surface 802*b* can release the engagement of the latch 4 with the ratchet 5 and the engagement of the latch 4 with the pull-in lever 606 via the lever ratchet 7 when the cam gear 8 is caused to revolve around in the second direction. Moreover, the stopper portion 802*c* is provided at the terminating end portion of the second cam surface 802*b*, and this stopper portion 802*c* restricts the cam portion 802 from revolving around in the second direction in such a state that the cam sliding portion 7*c* of the lever ratchet 7 is pressed by the second cam surface 802*b*. Because of this, in the event that the cam gear 8 stops extraordinarily in the midst of the latch 4 moving from the half latching position to the full latching position, the latch 4 can be returned to the open position without any delay. When the cam portion 802 is restricted from revolving around in the second direction, the cam portion 802 revolves around in the first direction and stops in the first waiting position. Consequently, even in the event that the tailgate is closed in the incompletely closed state where the latch 4 is held between the half latching position and the full latching position, the tailgate can be opened quickly so as to be closed again properly.

In the door lock apparatus of this embodiment, the pull-in lever 606 is connected to the second link shaft 605, and the pull-in portion 606*a* of the pull-in lever 606 and the pull-in engaging portion 4*g* of the latch 4 are brought into engagement with each other to thereby move the latch 4 to the full latching position. However, the method of moving the latch 4 to the full latching position is not limited to the method of using the pull-in lever 606. For example, a method may be adopted in which the second link 603 or the second link shaft 605 is brought into direct engagement with the latch 4.

The first link shaft 604 of the link mechanism 6 and the cam sliding portion 7*c* of the lever ratchet 7 which receive the pressing load from the cam portion 802 should be disposed so that the operation of moving the latch 4 from the half latching position to the full latching position and the operation of releasing the engagement of the latch 4 with the ratchet 5 can be executed individually and separately. Namely, the positional relationship between the first link shaft 604 of the link mechanism 6 and the cam sliding portion 7*c* of the lever ratchet 7 is not limited to the one described in this embodiment. Hence, the first link shaft 604 of the link mechanism 6 and the cam sliding portion 7*c* of the lever ratchet 7 should be disposed in such a positional relationship that the first link shaft 604 and the cam sliding portion 7*c* of the lever ratchet 7 can be pressed against individually and separately when the cam portion 802 is caused to revolve around in the first direction and that the cam sliding portion 7*c* can be pressed against when the cam portion 802 is caused to revolve around in the second direction. Consequently, the first link shaft 604 of the link mechanism 6 and the cam sliding portion 7*c* of the lever ratchet 7 can be disposed, for example, in an axial direction of the supporting shaft 13 so that the area of the revolving locus of the cam portion 802 where the first link shaft 604 overlaps and the area of the revolving locus of the cam portion 802 where the cam sliding portion 7*c* overlaps overlap each other. As this occurs, the first cam surface 802*a* of the cam portion 802 is divided into two in the axial direction of the supporting shaft 13, and one of the divided cam surfaces is made into a pull-in cam surface for pressing against the first link shaft 604, while the other of the divided cam surfaces is made into a releasing cam surface for pressing against the cam slicing portion 7*c* of the lever ratchet 7. Then, a top portion of the pull-in cam surface and a top portion of the releasing cam surface are offset from each other by a predetermined angle about the axis of the supporting shaft 13. This allows the first link shaft 604 and the cam sliding portion 7*c* can be pressed against individually and separately when the cam portion 802 is caused to revolve around in the first direction. Further, the second cam surface 802*b* is provided in a position on the first cam surface 802*a* of the cam portion 802 which corresponds to the releasing cam surface. This allows the cam portion 802 to revolve around in the second direction also when the cam gear 8 stop extraordinarily in the midst of moving the latch 4 from the half latching position to the full latching position, whereby the latch 4 can be returned to the open position without any delay.

In this embodiment, when the cam gear 8 is caused to revolve around in the second direction, the stopper portion 802*c* situated at the terminating end portion of the second cam surface 802*b* is brought into abutment with the cam sliding portion 7*c* of the lever ratchet 7 to thereby restrict the rotation of the cam gear 8. However, a configuration may be adopted in which the stopper portion 802*c* is not provided, and after the cam gear 8 has been moved to the second waiting position, the cam gear 8 is caused to revolve around in the first direction again so as to be returned to the first waiting position.

Figure 14:
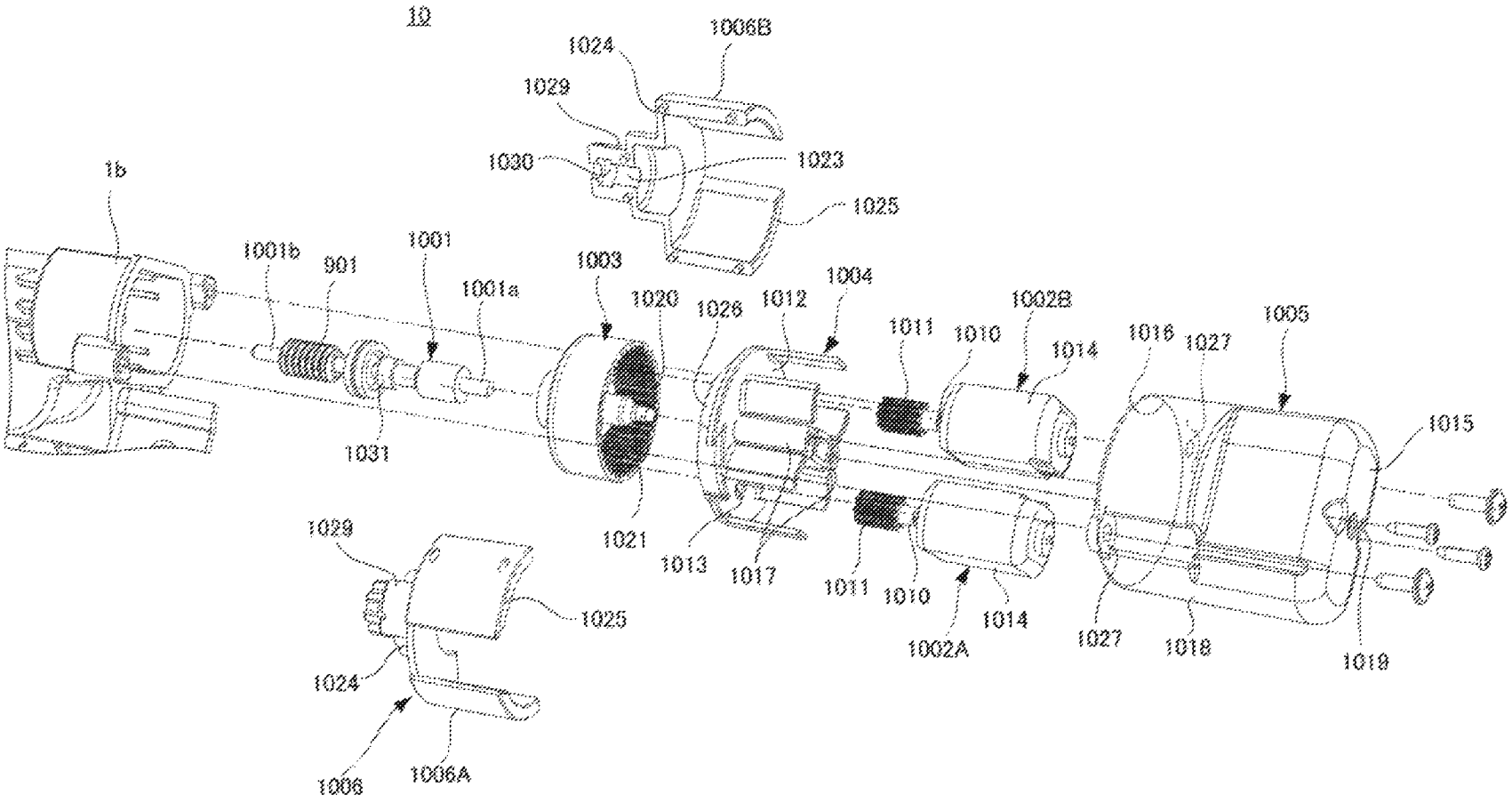
FIG. 14 is an exploded perspective view of a driving portion of the door lock apparatus shown in FIG. 1.
Figure 15:
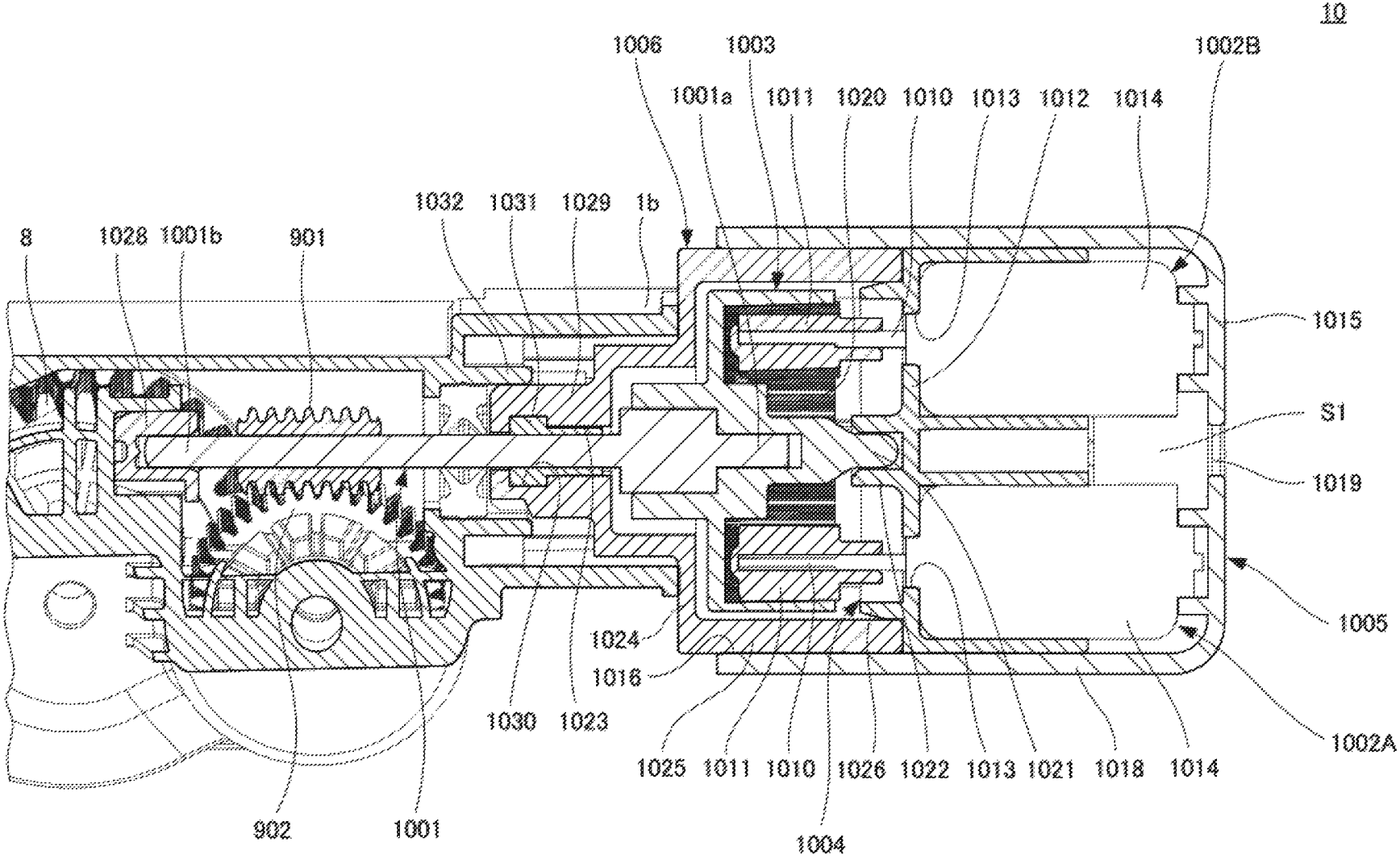
FIG. 15 is a sectional view of the driving portion of the door lock apparatus shown in FIG. 1.

Next, referring to FIGS. 14 and 15, the driving portion 10 will be described. FIG. 14 is an exploded perspective view of the driving portion 10, and FIG. 15 is a sectional view of the driving portion 10.

The driving portion 10 has the rotational shaft 1001 to which the worm 901 is attached as an output gear, two motors (drive sources) 1002A, 1002B, and an internally toothed or internal ring gear 1003. Operations of the motors 1002A, 1002B are controlled by the control circuit board described above. Additionally, the driving portion 10 has a base 1004, a case 1005 and a cover 1006.

The motors 1002A, 1002B are held on the base 1004, and output shafts 1010 of the motors 1002A, 1002B are disposed parallel to each other. Pinion gears 1011 are provided individually on the output shafts 1010.

The base 1004 has a substantially vertical bulkhead 1012 for the output shafts 1010 of the motors 1002A, 1002B, and two through holes 1013 are formed in the bulkhead 1012. The output shafts 1010 of the motors 1002A, 1002B are passed through the corresponding through holes 1013, and main bodies 1014 of the motors 1002A, 1002B and the pinion gears 1011 are disposed on opposite sides of the bulkhead 1012.

The case 1005 is formed into a cylindrical shape having a bottom wall 1015, and an opening portion 1016 is provided at an opposite end to the end where the bottom wall 1015 is provided. The motors 1002A, 1002B and the base 1004 are inserted through the opening portion 1016 into the case 1005 for accommodation therein. A plurality of bosses 1017 are provided on the bulkhead 1012, and the bosses 1017 are fastened to the bottom wall 1015 with fastening members such as screws, whereby the base 1004 is assembled to the case 1005.

The main bodies 1014 of the motors 1002A, 1002B are disposed between the bulkhead 1012 of the base 1004 and the bottom wall 1015 of the case 1005 and are accommodated within a space S1 which is defined by the bulkhead 1012, the bottom wall 1015 and a circumferential wall 1018 of the case 1005.

A ventilation hole 1019 is formed in the bottom wall 1015 so as to communicate with the space S1. The formation of the ventilation hole 1019 suppresses the generation of condensation in an interior of the space S1, thereby making it possible to suppress the generation of a failure such as a short-circuit in the motors 1002A, 1002B which is triggered by condensation. It should be noted that the ventilation hole 1019 may be formed in the circumferential wall 1018, provided that the ventilation hole 1019 communicates with the space S1.

The internal ring gear 1003 is formed into an annular shape, and a plurality of teeth 1020 are provided on an inner circumferential surface of the internal ring gear 103 so as to be aligned in a circumferential direction. The internal ring gear 1003 is disposed concentrically with the rotational shaft 1001 and is fixed to one end portion (a first end portion) 1001*a* of the rotational shaft 1001. Then, the internal ring gear 1003 is also passed through the opening portion 1016 into the case 1005 for accommodation therein in such a way that the rotational shaft 1001 becomes parallel to the output shafts 1010 of the motors 1002A, 1002B.

The internal ring gear 1003 is disposed on the side of the bulkhead 1012 of the base 1004 where the pinion gears 1011 of the motors 1002A, 1002B are disposed. The internal ring gear 1003 has a shaft portion 1021 which is provided coaxially with the rotational shaft 1001, and the shaft portion 1021 is supported rotatably by a bearing portion 1022 which is provided in the bulkhead 1012. It should be noted that the first end portion 1001*a* of the rotational shaft 1001 may extend through the internal ring gear 1003 so that the first end portion 1001*a* is supported rotatably by the bearing portion 1022.

The main bodies 1014 of the motors 1002A, 1002B and the internal ring gear 1003 are disposed on the opposite sides of the bulkhead 1012. In other words, the main bodies 1014 of the motors 1002A, 1002B and the internal ring gear 1003 are disposed in different planes in relation to an axial direction of the rotational shaft 1001. The pinion gears 1011 of the motors 1002A, 1002B are accommodated inside the internal ring gear 1003 and mesh with the teeth 1020 which are provided on the inner circumferential surface of the internal ring gear 1003. By adopting this arrangement, the driving portion 10 can be made small in size in a radial direction of the internal ring gear 1003.

The cover 1006 has a substantially circular lid portion 1024 having a passage hole 1023 which is formed in a center thereof and a cylindrical wall portion 1025 which extends from an outer circumferential edge of the lid portion 1024 in the direction of an axis. The cover 1006 is made up by combining together a first portion 1006A and a second portion 1006B which are divided by a plane which includes the axis.

The cover 1006 closes the opening portion 1016 in such a state that the rotational shaft 1001 is passed through the passage hole 1023 and that the cylindrical wall portion 1025 is passed through the opening portion 1016 into the case 1005 for accommodation therein. A fitting wall 1026 which is formed into an annular shape is provided on the bulkhead 1012 of the base 1004, and the cover 1006 is assembled to the base 1004 as a result of the cylindrical wall portion 1025 being fitted on the fitting wall 1026.

The other end portion (a second end portion) 1001*b* of the rotational shaft 1001 passes through the passage hole 1023 to be exposed from the case 1005, and the worm 901 is attached to the exposed second end portion 1001*b*.

The driving portion 10 is configured as a single unit by assembling together the base 1004, the case 1005 and the cover 1006. Then, the driving portion 10 is fixed to the fixing portion 1*b* which is provided on the housing (the case 1, the base plate 2 and the switch plate 3) of the door lock apparatus as the single unit. A plurality of fixing portions 1027 are provided on the case 1005, and these fixing portions 1027 are fixed to the fixing portion 1*b* with fastening members such as screws.

Here, the motors 1002A, 1002B and the internal ring gear 1003 are accommodated in the case 1005, and the opening portion 1016 of the case 1005 is closed by the cover 1006, whereby operation noise of the driving portion 10 such as motor noise and meshing noise of the internal ring gear 1003 and the pinion gears 1011 is confined within the case 1005. This enhances the quietness of the vehicle. Then, the noise shielding property can be enhanced as a result of the driving portion 10 being configured as the single unit.

In this example, although the ventilation hole 1019 which communicates with the space S1 where the motors 1002A, 1002B are accommodated is formed in the case 1005, the internal ring gear 1003 and the pinion gears 1011 which mesh with each other are held between the cover 1006 and the bulkhead 1012 of the base 1014 and are isolated from the space S1 by the bulkhead 012. By adopting this configuration, meshing noise of the internal ring gear 1003 with the pinion gears 1011 can be restricted from escaping through the ventilation hole 1019, thereby making it possible to enhance the noise shielding property further.

Further, in this example, the cylindrical wall portion 1025 of the cover 1006 covers an outer circumference of the internal ring gear 1003 in an interior of the case 1005, and the internal ring gear 1003 is covered double by the circumferential wall 1018 of the case 1005 and the cylindrical wall portion 1025. This can enhance more the noise shielding performance against the meshing noise of the internal ring gear 1003 with the pinion gears 1011.

The fixing portions 1027 may be provided on the base 1004 and the cover 1006. However, the fixing portions 1027 are provided preferably on any one of the base 1004, the case 1005 and the cover 1006. In a case where the fixing portions 1027 are provided so as to scatter on the base 1004, the case 1005 and the cover 1006, there may be fears that it becomes complex and troublesome to adjust the positions of the fixing portions 1027 and the fixing portion 1*b* due to assembling errors of the base 1004, the case 1005 and the cover 1006. However, the adjustment of the positions of the fixing portions 1027 and the fixing portion 1*b* becomes easy and simple by providing the fixing portions 1027 on any one of the base 1004, the case 1005 and the cover 1006, this facilitating the fixing of the driving portion 10.

A distal bush 1028 is provided on the housing of the door lock apparatus, and the second end portion 1001*b* of the rotational shaft 1001 is supported rotatably by the distal bush 1028 with the driving portion 10 fixed to the fixing portion 1*b*. Namely, both the end portions of the rotational shaft 1001 are supported by the bearing portion 1022 of the base 1004 and the bush 1028, and a middle portion of the rotational shaft 1001 is supported further by the cover 1006 in this example.

A supporting portion 1029 which is formed into a cylindrical shape is provided on the lid portion 1024 of the cover 1006, and the passage hole 1023 is formed in such a way as to penetrate the supporting portion 1029. An annular recess portion 1030 is provided on an inner circumferential surface of the passage hole 1023, and a middle bush 1031 is fixed to a middle portion of the rotational shaft 1001 which is disposed in the passage hole 1023. The middle portion of the rotational shaft 1001 is supported rotatably by the cover 1006 as a result of the middle bush 1031 fitted in the recess portion 1030.

Then, a fitting portion 1032 which is formed into a cylindrical shape is provided on the fixing portion 1*b* of the housing of the door lock apparatus, and the supporting portion 1029 is fitted in the fitting portion 1032 with the driving portion 10 fixed to the fixing portion 1*b*.

Vibrations of the rotational shaft 1001 are mitigated by supporting the middle portion of the rotational shaft 1001, that is, a portion disposed between the worm 901 and the internal ring gear 1003, whereby the meshing noise of the internal ring gear 1003 with the pinion gears 1011 and meshing noise of the worm 901 with the worm wheel 902 are mitigated. This enhances the quietness of the vehicle.

Then, the supporting portion 1029 of the cover 1006 which supports the middle portion of the rotational shaft 1001 fits in the fitting portion 1032 of the housing of the door lock apparatus, whereby the middle portion of the rotational shaft 1001 is supported on the housing of the door lock apparatus via the supporting portion 1029. This can mitigate further the vibrations of the rotational shaft 1001, whereby the quietness of the vehicle is enhanced further.

Thus, while the invention has been described by taking as an example the door lock apparatus which assists in closing the tailgate by pulling the latch 4 which is in engagement with the striker S into the full latching position, the door lock apparatus may be configured so as to assist in opening the tailgate by pushing out the latch 4 which is in engagement with the striker S to the open position.

The invention claimed is:

1. A door lock apparatus configured to be provided on a vehicle door, comprising:

a lock mechanism configured to hold the vehicle door in a closed state;

an assisting mechanism configured to assist in closing and/or opening the vehicle door; and a driving portion configured to operate the assisting mechanism, wherein the driving portion comprises:

a plurality of drive sources, in which output shafts are disposed parallel to each other and pinion gears are provided individually on the output shafts;

a rotational shaft that is disposed parallel to the respective output shafts of the plurality of drive sources;

an internal ring gear, which is fixed to a first end portion of the rotational shaft, and which meshes with the respective pinion gears of the plurality of drive sources; and an output gear, which is fixed to a second end portion of the rotational shaft, and which is configured to transmit power to the assisting mechanism.

2. The door lock apparatus according to claim 1, further comprising:

a housing, which holds the lock mechanism and the assisting mechanism, and which supports rotatably the second end portion of the rotational shaft, wherein the driving portion comprises:

a base, which holds the plurality of drive sources, and which supports rotatably the first end portion of the rotational shaft or the internal ring gear;

a case, which is formed into a bottomed cylindrical shape, and which accommodates the plurality of drive sources, the internal ring gear and the base therein; and a cover that closes an opening portion of the case with the second end portion of the rotational shaft and the output gear exposed, and wherein a plurality of fixing portions configured to be fixed to the housing are provided on a unit which is made up by assembling together the base, the case and the cover.

3. The door lock apparatus according to claim 2, wherein the plurality of fixing portions are provided on any one of the base, the case and the cover.

4. The door lock apparatus according to claim 2, wherein the base comprises a bulkhead that divides an interior of the case in an axial direction of the rotational shaft, wherein a plurality of through holes, through which output shafts of the plurality of drive sources are penetrated, are formed in the bulkhead, and wherein the internal ring gear is held between the cover and the bulkhead in the interior of the case.

5. The door lock apparatus according to claim 4, wherein the cover has a cylindrical wall portion that covers an outer circumference of the internal ring gear in the interior of the case.

6. The door lock apparatus according to claim 2, wherein the cover comprises a supporting portion configured to support the rotational shaft rotatably.

7. The door lock apparatus according to claim 6, wherein the housing comprises a fitting portion that fits in or on the supporting portion.

8. The door lock apparatus according to claim 2, wherein the cover comprises one or more ventilation holes that communicate with a space where the plurality of drive sources are accommodated.

* * * * *